US007614714B2

(12) United States Patent
Masuyama et al.

(10) Patent No.: US 7,614,714 B2
(45) Date of Patent: Nov. 10, 2009

(54) LIQUID APPLICATION DEVICE AND INK JET RECORDING APPARATUS

(75) Inventors: Atsuhiko Masuyama, Yokohama (JP); Osamu Iwasaki, Tokyo (JP); Yoshinori Nakagawa, Kawasaki (JP); Naomi Oshio, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 222 days.

(21) Appl. No.: 11/538,268

(22) Filed: Oct. 3, 2006

(65) Prior Publication Data

US 2007/0126836 A1 Jun. 7, 2007

(30) Foreign Application Priority Data

Dec. 7, 2005 (JP) ..... 2005-353973

(51) Int. Cl.
*B41J 29/38* (2006.01)

(52) U.S. Cl. ..... 347/16; 347/5; 347/9; 347/103

(58) Field of Classification Search ..... 347/16, 347/19

See application file for complete search history.

(56) References Cited

U.S. PATENT DOCUMENTS 6,786,588 B2 * 9/2004 Koyano et al. ..... 347/100
2005/0151772 A1 * 7/2005 Oishi ..... 347/16
2005/0179720 A1 8/2005 Iwasaki et al.
2006/0176325 A1 8/2006 Seki et al.
2007/0034102 A1 2/2007 Oshio et al.
2007/0034152 A1 2/2007 Nakagawa et al.
2007/0035592 A1 2/2007 Oshio et al.
2007/0035593 A1 2/2007 Iwasaki et al.
2007/0070163 A1 3/2007 Masuyama et al.
2007/0101936 A1 5/2007 Masuyama et al.
2007/0126835 A1 6/2007 Oshio et al.

FOREIGN PATENT DOCUMENTS

JP 8-058069 3/1996
JP 2002-096452 4/2002
JP 2002-137383 5/2002

* cited by examiner

*Primary Examiner*—Lam S Nguyen
(74) *Attorney, Agent, or Firm*—Fitzpatrick, Cella, Harper & Scinto

(57) ABSTRACT

The present invention provides an inkjet recording apparatus and a recording apparatus capable of reducing wear of a roller for application, even if liquid (for example, application liquid) is insufficient in a case where liquid is applied to recording media. In an embodiment of the present invention, in a case where it is determined that the application liquid is sufficient in a storage tank, the application liquid is filled in a liquid retention space, the application liquid is applied to the recording medium, and thus recording is performed. In a case where it is determined that the liquid application is insufficient in the storage tank, recording with application is prohibited.

2 Claims, 23 Drawing Sheets

LIQUID APPLICATION DEVICE AND INK JET RECORDING APPARATUS

BACKGROUND OF THE INVENTION

1. Field of the Invention

The present invention relates to an inkjet recording apparatus. Specifically, it relates to an inkjet recording apparatus which includes a mechanism for applying liquid to a recording medium used in inkjet recording, for a purpose which is, for example, to promote the aggregation of pigment when recording is carried out using an ink containing the pigment as a coloring material.

2. Description of the Related Art

Conventionally, in the field of inkjet recording, there is known a method for applying a pretreatment liquid as an application liquid to a recording area in advance using an application roller in order to improve the quality of images to be recorded on a recording medium. In connection with the aforementioned method, Japanese Patent Application Laid-open No. 2002-137383 A has proposed that recording media requiring pretreatment and those not requiring it are transferred using different transfer passages. In Japanese Patent Application Laid-open No. 2002-137383 A, a mark formed at a designated position of the recording medium is detected by a sensor, thereby finding out what type of recording medium is to be used for printing. Subsequently, a switching claw is caused to turn to match the recording medium with a passage, namely, to guide the recording medium to either an application process passage (a passage where the pretreatment liquid is applied) or an application unnecessary passage (a passage where no pretreatment liquid is applied). In other words, the passage to be followed by the recording medium is selected according to the type of recording medium that is to be used for recording.

In Japanese Patent Application Laid-open No. 2000-137383 A, however, either the application process passage (passage with application) or an application unnecessary passage (passage without application) is selected according to the type of recording medium (paper) that is to be used, but as to the operation in a state that the application liquid is insufficient (or runs out), no explanation is given.

Generally known is the following fact. In the recording apparatus that performs inkjet recording on the recording medium to which application liquid has been applied by a roller, a shortage of the application liquid dries out the liquid circulation circuit including the application roller, and increases the friction resistance of the surfaces of the roller. If printing is continued in this state and in the same way as it has been carried out, the surface of the application roller will be worn out by rollers of various types, which are opposite the application roller (i.e. counter rollers), and by the very recording media. In other words, the shortage of application liquid means that the pretreatment liquid (application liquid) functioning as a lubricant is not left between the application roller and the counter roller or recording medium, or if it is, only insufficiently. As a result, the frictional force between the application roller and the counter roller or recording medium will be increased, and wear of the application roller will progress. Use of a roller with its surface being worn out in applying liquid will not produce the image quality that can otherwise be expected.

As mentioned above, in Japanese Patent Application Laid-open No. 2002-137383 A, the most suitable passage for the recording media is selected. The recording operation, however, is performed following the selected passage even in a case where the pretreatment liquid is insufficient. As a result, there is a possibility that wear of the application roller may progress and may harm the image quality.

SUMMARY OF THE INVENTION

It is an object of the present invention is to provide an inkjet printing apparatus and a recording apparatus capable of reducing wear of a roller involved in application even if liquid (for example, application liquid) is insufficient in a case of applying the liquid to a recording medium.

In first aspect of the present invention, an inkjet recording apparatus capable of recording on a recording medium by ejecting ink from a recording head to the recording medium to which liquid is applied, comprises: application means for applying the liquid to the recording medium; a first transfer passage having the application means disposed therein, and transferring the recording medium, to which the liquid has been applied by the application means, to a position facing the recording head; storage means for storing the liquid to be supplied to the application means; determination means for determining whether an amount of liquid stored in the storage means is smaller than a designated amount; and prohibition means for prohibiting transfer of the recording medium using the first transfer passage in a case where it is determined that the amount of liquid is smaller than the designated amount.

In second aspect of the present invention, an inkjet recording apparatus being capable of recording on a recording medium by ejecting ink from a recording head to the recording medium to which liquid is applied, comprises: application means for applying the liquid to the recording medium; a first transfer passage having the application means disposed therein, and transferring the recording medium, to which the liquid has been applied by the application means, to a position facing the recording head; a second transfer passage having no application means disposed therein, and transferring the recording medium, to which the liquid is not applied, to the position facing the recording head; storage means for storing the liquid to be supplied to the application means; determination means for determining whether an amount of liquid stored in the storage means is smaller than a designated amount; and prohibition means for prohibiting use of the first transfer passage, and for allowing use of the second transfer passage, in a case where it is determined that the amount of liquid is smaller than the designated amount.

In third aspect of the present invention, a recording apparatus capable of recording on a recording medium by applying a recording agent from recording means to the recording medium to which liquid has been applied by application means, comprises: a transfer passage having the application means disposed therein, and transferring the recording medium, to which the liquid has been applied by the application means, to the recording means; storage means for storing the liquid to be supplied to the application means; determination means for determining whether an amount of liquid stored in the storage means is smaller than a designated amount; and prohibition means for prohibiting transfer by the transfer passage in a case where it is determined that the amount of liquid is smaller than the designated amount.

In fourth aspect of the present invention, a control method for an inkjet recording apparatus capable of recording on a recording medium by ejecting ink from a recording head to the recording medium to which liquid has been applied by liquid application means, comprises the steps of: determining whether an amount of liquid stored in storage means for storing the liquid to be supplied to the application means is smaller than a designated amount; and prohibiting transfer of the recording medium by a transfer passage having the application means disposed therein in a case where it is determined that the amount of liquid is smaller than the designated amount.

According to the present invention, in a case where it is determined that the amount of liquid (for example, the application liquid) stored in the storage means is less than a designated amount, transfer using the first transfer passage where application is performed (for example, passage with application) is prohibited. As a result, wear of the application means can be reduced and the performance of the application means can be maintained. In this way, a high quality image is recorded.

Further features of the present invention will become apparent from the following description of exemplary embodiments (with reference to the attached drawings).

BRIEF DESCRIPTION OF THE DRAWINGS

FIG. 20 is a diagram showing the relationship of FIGS. 20A to 20C;

DESCRIPTION OF THE EMBODIMENTS

First Embodiment

The following will specifically explain preferred embodiments of the present invention with reference to the drawings.

Figure 1:
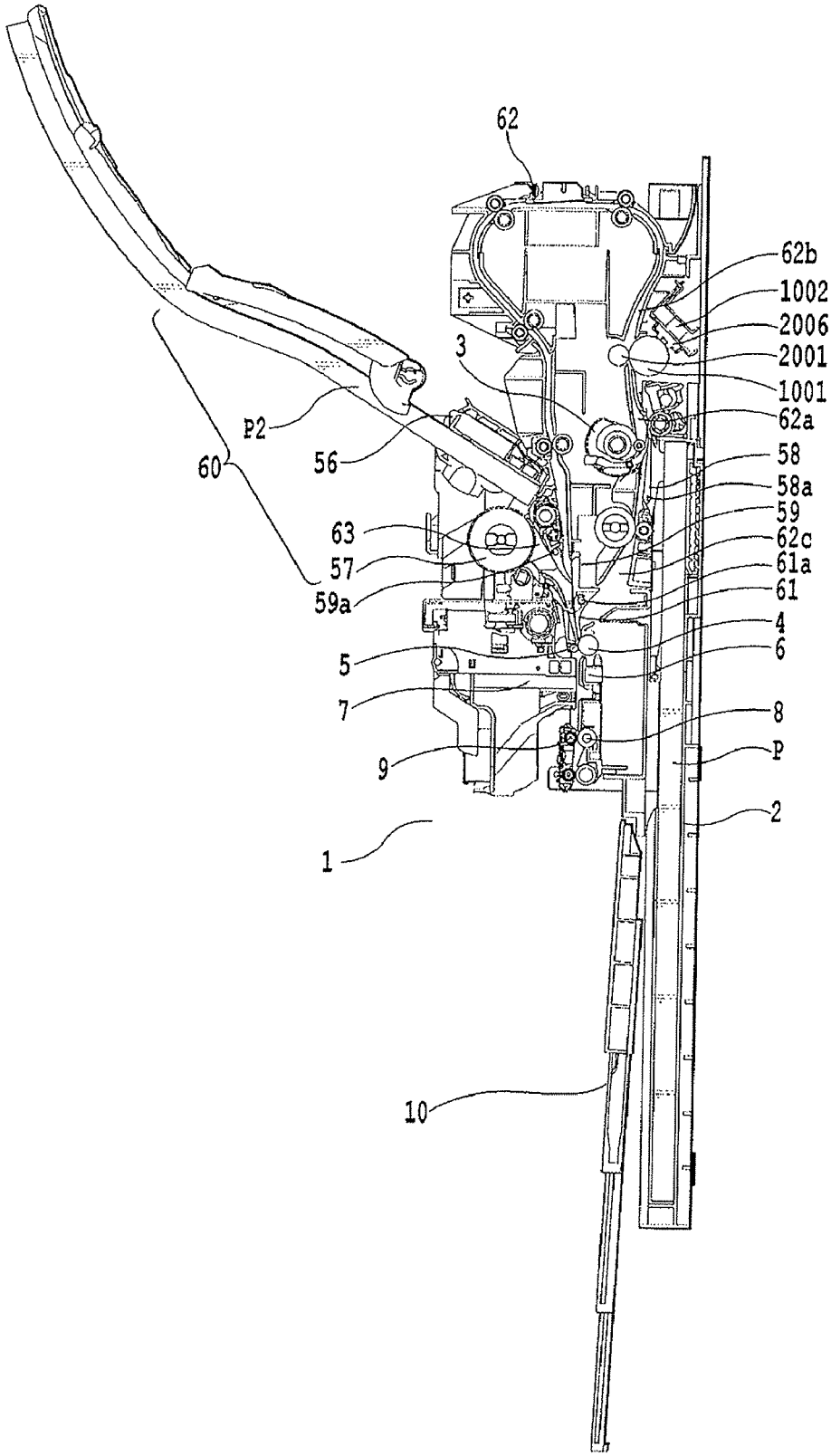
FIG. 1 is a vertical sectional view showing a schematic configuration of an inkjet printer according to the present invention.

FIG. 1 is a view illustrating a schematic configuration of an inkjet printer as an embodiment of an inkjet recording apparatus according to the present invention. The inkjet printer of this embodiment includes a liquid application mechanism that applies liquid to printing media such as recording paper.

An inkjet recording apparatus 1 is provided with a feed cassette (paper feeding section) 2 on which a plurality of sheets of recording media P are stacked. In a case where a passage with application is selected, a separation roller (paper feeding roller) 3 having a half-moon shaped cross section separates the recording media P stacked on the feed cassette 2 one by one and feeds each medium to the transfer passage. In the transfer passage, there are disposed an application roller 1001, which constitute an application member of a liquid application mechanism and a counter roller 1002, to transfer the recording medium being interposed in between. The application roller 1001 is caused to rotate clockwise in FIG. 1 by the rotation of a roller drive motor, transfers the recording medium P upward in the figure, and applies the application liquid to a part of the recording medium P, to which the application is required.

Additionally, in the present specification, it should be noted that the "passage with application" is a passage which is configured to apply the application liquid to the recording medium, and in which a mechanism for applying the application liquid is provided. Moreover, the "passage without application" is a passage where no application liquid is applied to the recording medium.

Figure 15:
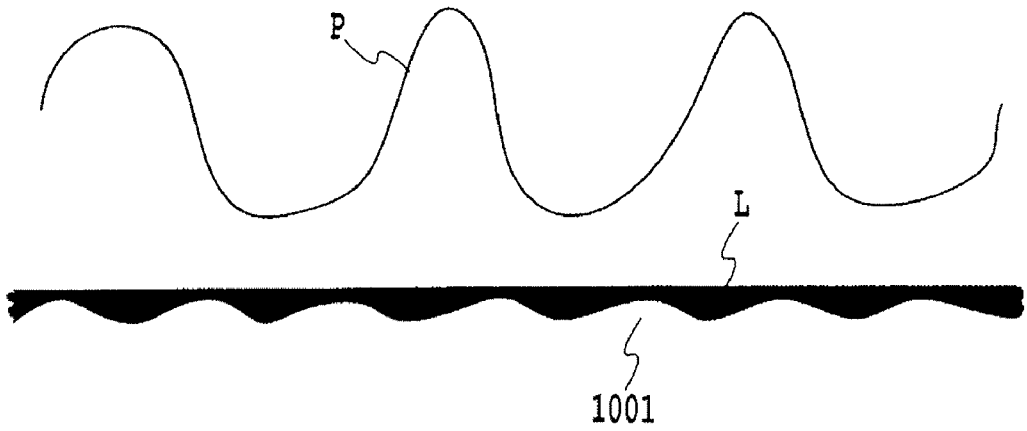
FIG. 15 is an explanatory diagram for explaining an application process proceeding between an application surface and a surface of the medium in a case where the medium P is a plain paper.
Figure 16:
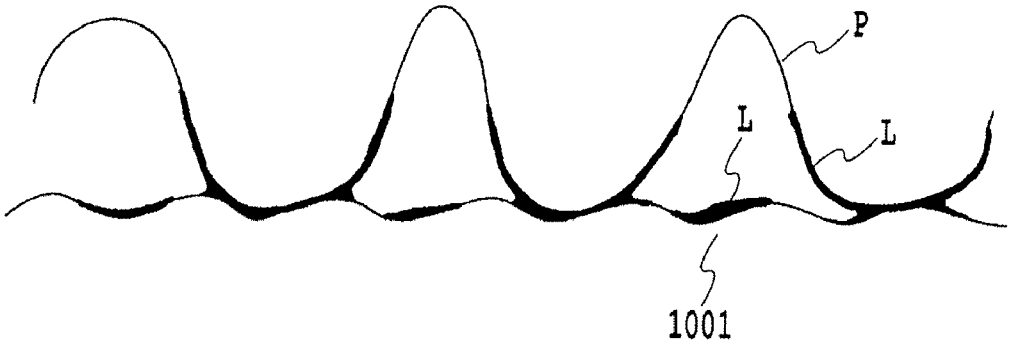
FIG. 16 is an explanatory diagram for explaining an application process proceeding between an application surface and a surface of the medium in a case where the medium P is a plain paper.
Figure 17:
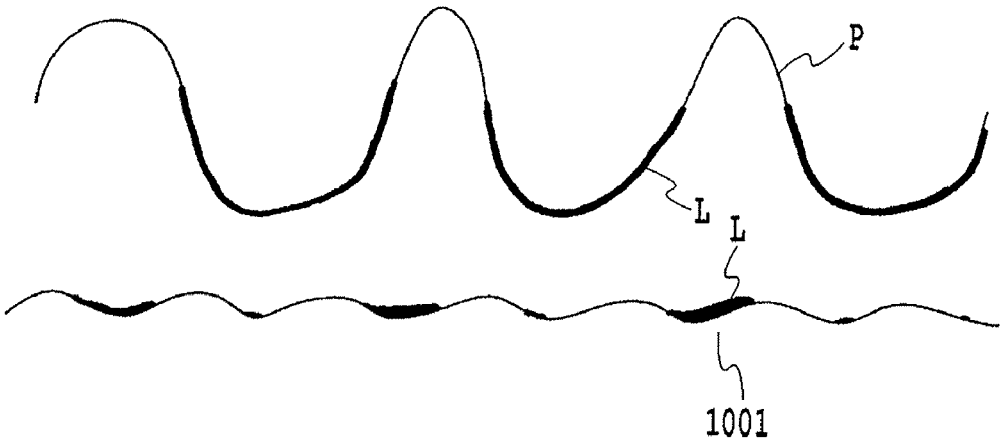
FIG. 17 is an explanatory diagram for explaining an application process proceeding between an application surface and a surface of the medium in a case where the medium P is a plain paper.

Unlike the gravure printing as shown in Japanese Patent Application Laid-open No. H08-58069 A, the pattern of image to be recorded with ink is not formed on a surface (circumferential surface) of the application roller 1001, or more exactly, no image pattern is formed at all on the surface. The application roller 1001 is formed to have a surface with substantially no irregularities to apply the application liquid uniformly to the recording medium. Strictly speaking, the surface of the roller is not perfectly smooth and microscopic irregularities are present thereon as illustrated in FIGS. 15 to 17 to be described later. These irregularities, however, are not used for forming the image pattern, but the irregularities are merely of the degree, which are generated by a manufacturing error. Accordingly, in this case, the surface having irregularities within the range of manufacturing error is called the surface with substantially no irregularities.

The recording medium P to which the application liquid has been applied is sent to the interface between a transfer roller 4 and a pinch roller 5, and by driving to rotate the transfer roller 4 counterclockwise (in FIG. 1), the recording medium P is transferred on a platen 6.

Recording is performed, at a position facing a recording head 7, on the recording medium P transferred on the platen 6. Namely, the recording head 7 is an inkjet recording head in which a designated number of nozzles for ejecting ink are arranged. While the recording head 7 scans in a direction perpendicular to the plane of sheet on which FIG. 1 is drawn, recording is carried out by ejecting ink droplets from the nozzles to the recording medium P in accordance with the recording data. By alternately repeating the recording operation and the transferring operation in a certain feeding amount by the transfer roller 4, recording is performed on the recording medium to which the application liquid has been applied, or on the recording medium to which the application liquid is not applied. As the recording operation is going on, the recording medium P is delivered onto a delivery tray 10 by a delivery roller 8 and a spur 9 provided in the transfer passage of the recording media P at a point downstream of the scanning region of the recording head.

Moreover, in a second transfer passage to be described later, there is used a second paper feeding section 60 having a pressure plate 56 and a paper feeding roller 57 that are used to feed recording media P2. A transfer passage 62 is a large roundabout route from the transfer roller 4, through the application roller 1001, and back to the transfer roller 4. The transfer passage 62 includes a transfer passage 62*a* leading to the application roller 1001 from the paper feeding roller 3, a transfer passage 62*b* leading to the transfer roller 4 from the application roller 1001, and a transfer passage 62*c* leading to the paper feeding roller 3 from the transfer roller 4. Reference numeral 63 is a transfer passage, which extends in the direction of the transfer roller 4 from the paper feeding section 60, and then joins the transfer passage 62. Furthermore, in transfer passages, transfer guides 58, 59, and 61 are arranged to be turnable about pivot shafts 58*a*, 59*a*, and 61*a*, respectively. These transfer guides 58, 59, and 61 turn about the corresponding pivot shafts 58*a*, 59*a*, and 61*a*, as the user desires. As a result, the passage switching, such as the switching between the passage with application and the passage without application, is performed. Note that the turning of each transfer guide (the switching between the passage with application and the passage without application) is caused by a control signal from a control unit 5000, which is to be described below.

Next, an explanation will be given of the operations and the transfer passages in the aforementioned configuration. The first transfer passage is the passage with application. In the first transfer passage, to the recording medium P fed from the paper feeding section 2, the application liquid is applied, and then the recording medium P to which the application liquid has been applied is transferred to a position facing the recording head 7. A sheet of the recording medium P separated from those on the paper feeding section 2 by the paper feeding roller 3 enters the transfer passage 62*a* by making the transfer guide 58 turn left. Namely, a drive motor (not shown) is driven to turn the transfer guide 58 about the pivot shaft 58*a*, and the paper feeding section 2 is connected to the transfer passage 62*a*. In this way, the recording medium P is transferred to the transfer passage 62*a* from the paper feeding section 2. Subsequently, the recording medium P, with a surface to which the application liquid has been applied by the application roller 1001, is transferred along the transfer passage 62*b*, makes the transfer guide 59 turn right, and reaches the transfer roller 4 with the liquid-applied surface directed to the recording head 7. In other words, a drive motor (not shown) is driven to turn the transfer guide 59 about the pivot shaft 59*a*, establishes the passage leading to the transfer roller 4 from the application roller 1001, and then the recording medium P to which the application liquid has been applied is transferred to the recording head 7. After that, an image is recorded, by the recording head 7, on the surface of the recording medium P to which the application liquid has been applied.

The second transfer passage is the passage without application. In the second transfer passage, recording is performed on one surface of the recording medium P2 fed from the paper feeding section 60 after being separated from those stacked on the paper feeding section 60. The recording is performed without applying the application liquid to the recording medium P2. The recording medium P2 having been separated by the pressure plate 56 and the paper feeding roller 57 is transferred through the transfer passage 63. Guided by the transfer guide 59, the recording medium P2 is sent to the transfer passage 62*b*. In other words, a drive motor (not shown) is driven to turn the transfer guide 59 about the pivot shaft 59*a*, the transfer passage 63 is connected to the transfer passage 62*b*, and then the recording medium P2 is transferred to the transfer passage 62*b* from the paper feeding section 60. Next, an image is recorded on the recording medium P2 by the recording head 7 while the recording medium P2 is transferred to the transfer roller 4. When the recording is completed, the recording medium P2 is delivered onto a delivery tray 10. In the case of single-sided recording, the recording operation is completed here. However, in the case of double-sided recording, the recording medium P2 having been delivered onto the delivery tray 10 is manually placed in the paper feeding section 60 again to perform recording on the back side of the recording medium P2.

A third transfer passage is a passage for performing double-sided recording. On completion of recording on a first side of the recording medium performed, while not ejecting the paper, using the first (or second) transfer passage, a drive motor (not shown) is driven to turn the transfer guide 61 right, and thereafter the transfer roller 4 and the delivery roller 8 reverse the rotation. The recording medium is fed backward, but does not enter the transfer passage 62*b*. The recording medium makes an entry into the transfer passage 62*c* since the transfer guide 61 is made to be turned right. In other words, the drive motor is driven, the transfer guide 61 is made to turn about the pivot shaft 61*a*, and the passage leading to the transfer passage 62*c* from the recording head 7 is established. At this time, the recording medium fed backward is transferred to the transfer passage 62*c*.

After that, the recording medium is guided by the transfer guide 58 and reaches the application roller 1001 through the transfer passage 62*a*. In other words, the drive motor is driven to make the transfer guide 58 turn about the pivot shaft 58*a*, the transfer passage 62*c* is connected to the transfer passage 62*a*, and then the recording medium is transferred to the application roller 1001 from the transfer roller 4. Subsequently, the application liquid is applied, by the application roller 1001, to a second side on which no recording has been made yet. The resultant recording medium reaches the transfer roller 4 through the transfer passage 62*b*. Needless to say, at this time, the drive motor is driven to turn the transfer guides 59 and 61 and thus, the passage leading to the transfer roller 4 from the application roller 1001 is established. On the second side of the recording medium transferred to the transfer roller 4 by the recording head 7, an image is recorded. The recording medium on which the recording has been completed is discharged to the outside of the recording apparatus by the delivery roller 8 and the present processing finishes.

Additionally, in this embodiment, if the passage has already been established as being required for the recording medium to pass through the transfer guide 58, 59, or 61, there is no need to turn the transfer guide 58, 59, or 61.

Furthermore, in this embodiment, it is possible to perform two-sided printing in both automatic and manual modes. In the case of the automatic mode, the third transfer passage may be used. Alternatively, in the case of the manual mode, the user may place the recording media discharged onto the delivery tray 10 in a designated paper feeding section in such a way that recording is made on the surface opposite to the surface on which the recording has already been made.

In addition, as the inkjet recording apparatus used in this embodiment, it is possible to employ a so-called full-line-type inkjet recording apparatus. This type of apparatus performs a recording operation using a long recording head in which nozzles for discharging ink are arranged over the maximum width of recording medium.

In addition, the application liquid used in this embodiment is a liquid (treatment liquid) for the purpose of coagulating the pigment as a coloring material of ink. The following is the composition.

calcium nitrate tetrahydrate 10%
glycerin 42%
surfactant agent 1%
water the rest The viscosity of the application liquid is from 5 to 6 cP (centipoises) at 25° C.

In this embodiment, the treatment liquid is used as the application liquid. The treatment liquid react with the pigment as the coloring material of ink to be ejected onto the recording medium to which the treatment liquid has been applied to promote the coagulation of pigment. By promoting the coagulation of pigment, an improved recording density can be attained. In addition, bleeding can be reduced or prevented. Needless to say, the application liquid used in an inkjet recording apparatus is not limited to the above example. A liquid containing a component insolubilizing or coagulating the dye can be used as another example of application liquid. As yet another example of application liquid, a liquid containing a component which suppresses the curling of the recording media (the phenomenon that the media take a curved shape) can be used.

In a case where water is used in the application liquid, the rotatability at the contact area of the liquid retention member with the application roller of the present invention becomes favorable by mixing a component reducing the surface tension with the liquid. In the above example of the components of the application liquid, glycerin and the surfactant agent are the components reducing the surface tension of water.

Figure 2:
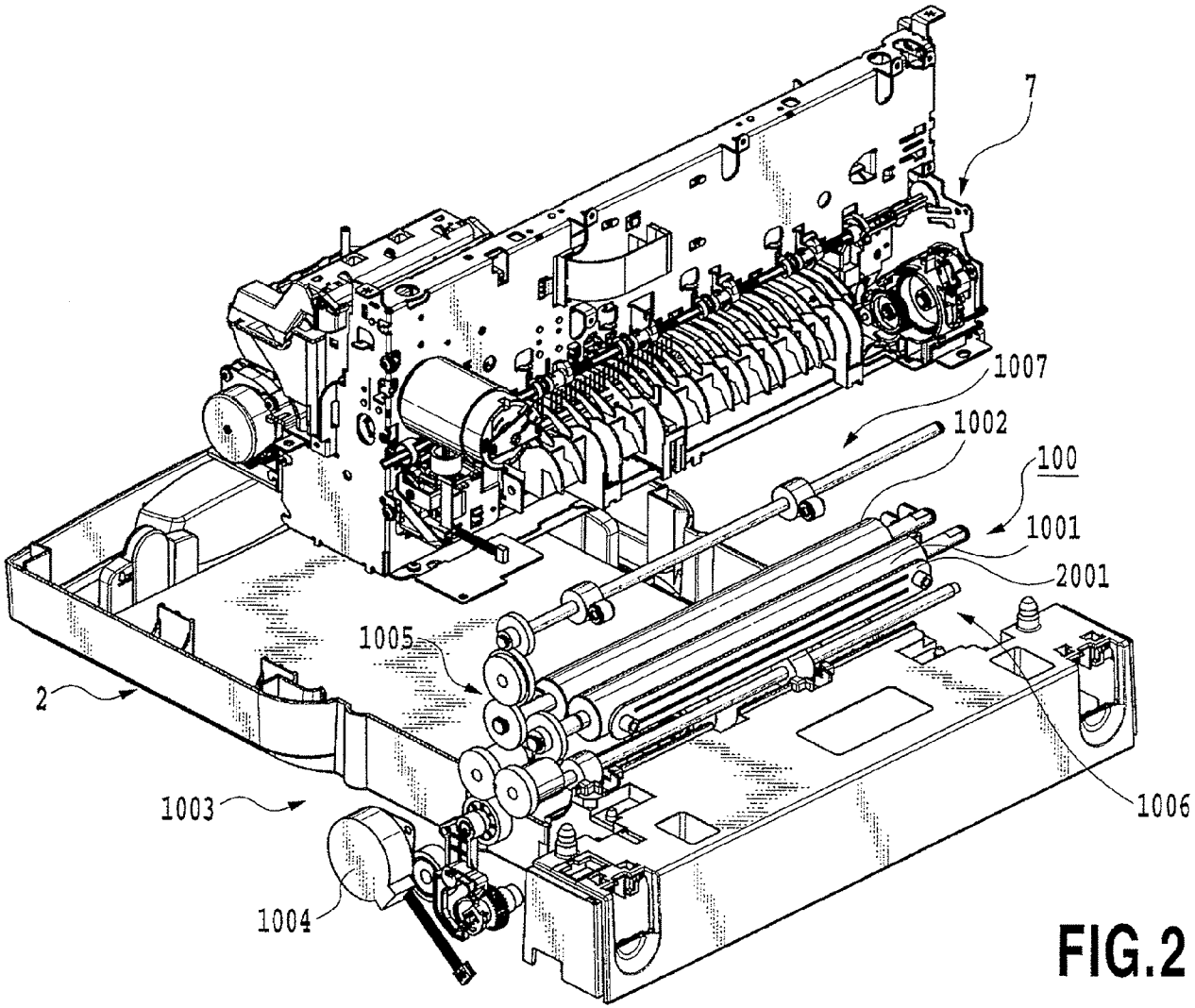
FIG. 2 is a perspective view showing mainly a recording mechanism and a liquid application mechanism in the inkjet printer illustrated in FIG. 1.

FIG. 2 is a perspective view illustrating the main part of the aforementioned inkjet printer with the case of the apparatus being removed. As illustrated in the figure, an application mechanism 100 is disposed above an end of the delivery tray 2. A recording mechanism including the recording head 7 and the like is disposed roughly above the center of the delivery tray 2, and is located superior to the application mechanism.

The liquid application device 100 shown here generally includes liquid application means for applying a predetermined application liquid to a recording medium which is an object to which the liquid is applied and liquid supply means for supplying the application liquid to the liquid application means.

As shown in FIG. 2, the liquid application means includes a cylindrical application roller 1001, a cylindrical counter roller (a medium supporting member) 1002 placed so as to face the application roller 1001 and a roller drive mechanism 1003 driving the application roller 1001. The roller drive mechanism 1003 includes a roller drive motor 1004 and a power transmission mechanism 1005 including a gear train for transmitting the driving force of the roller drive motor 1004 to the application roller 1001.

The liquid supply means includes a liquid retention member 2001 retaining the application liquid between itself and a circumferential surface of the application roller 1001, and a liquid channel 3000 (not shown in FIGS. 1 and 2), to be described later, supplying the liquid to the liquid retention member 2001. The application roller 1001 and the counter roller 1002 are freely rotatably supported individually by parallel shafts, each of which has both ends thereof freely rotatably fitted to a frame not shown. The liquid retention member 2001 extends substantially over the entire length of the application roller 1001, and is movably mounted to the frame via a mechanism which enables the liquid retention member 2001 to come into contact with or to separate from the circumferential surface of the application roller 1001.

As above-mentioned in FIG. 1, the printer of this embodiment further includes an application medium feeding mechanism 1006 for transferring the application medium to a nip area between the application roller 1001 and the counter roller 1002, the application medium feeding mechanism 1006 being constituted of a pickup roller and other elements. In a transfer path of the application media, a sheet discharging mechanism 1007 transferring, to a sheet discharging unit (not shown), the application medium to which the application liquid has been applied is provided downstream of the application roller 1001 and the counter roller 1002, the sheet discharging mechanism 1007 having a sheet discharging roller and other elements. As in the case of the application roller and the like, these paper feeding mechanism and the sheet discharging mechanism are operated by the driving force of the drive motor 1004 transmitted via the power transmission mechanism 1005.

More detailed description will now be given of construction of each portion.

Figure 3:
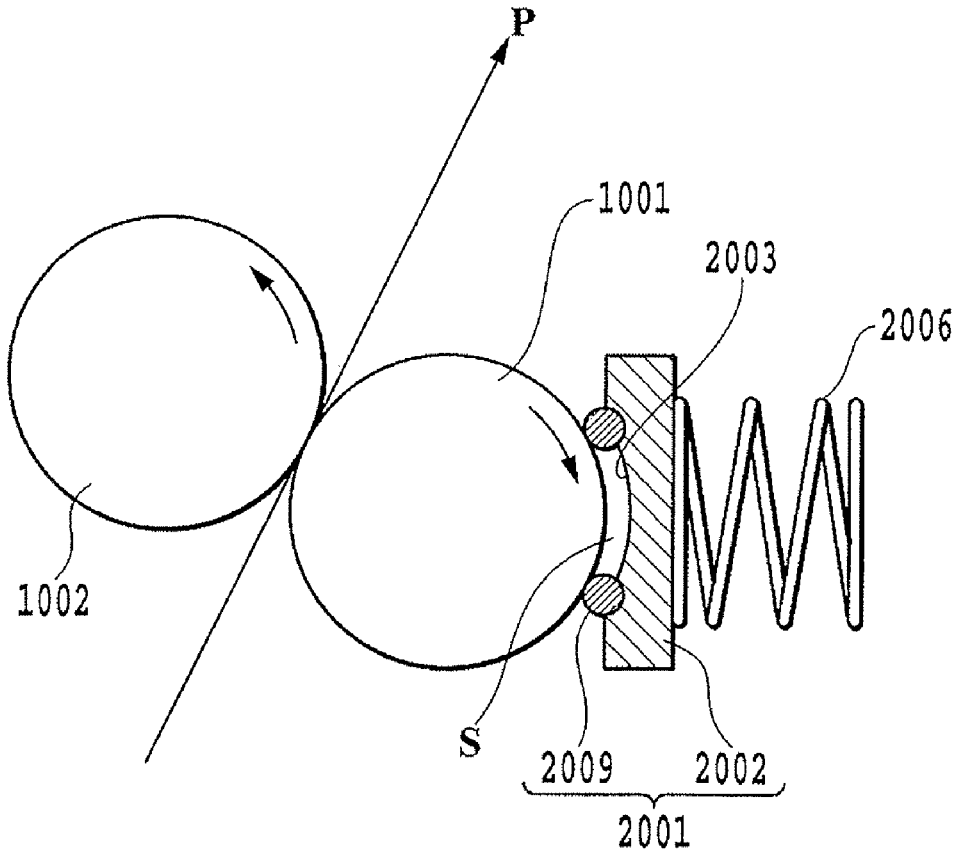
FIG. 3 is a longitudinal sectional side view showing an example of an arrangement of elements including an application roller, a counter roller and a liquid retention member illustrated in FIGS. 1 and 2.

FIG. 3 is an explanatory longitudinal sectional side view showing an example of an arrangement of elements including the application roller 1001, the counter roller 1002 and the liquid retention member 2001.

The counter roller 1002 is biased toward the circumferential surface of the application roller 1001 by bias means not shown, and rotates the application roller 1001 clockwise in the figure. This rotation makes it possible to hold, between both rollers, the application medium P to which the application liquid is applied, and to transfer the application medium P in the direction indicated by the arrow in the figure.

The liquid retention member 2001 includes a space creating base 2002 and an annular contact member 2009, and is biased by the bias force of sprig 2006 to abut on the circumferential surface of the application roller 1001. An elongated liquid retention space S extending across a liquid application region of the application roller 1001 is formed by the abutment. The application liquid is supplied from the below-described liquid channel 3000 into the liquid retention space S through the liquid retention member 2001. In this case, since the liquid retention member 2001 is constructed as described below, it is possible to prevent the application liquid from accidentally leaking out of the liquid retention space S while the application roller 1001 is stopped.

A construction of the liquid retention member 2001 is shown in FIGS. 4 to 9.

Figure 4:
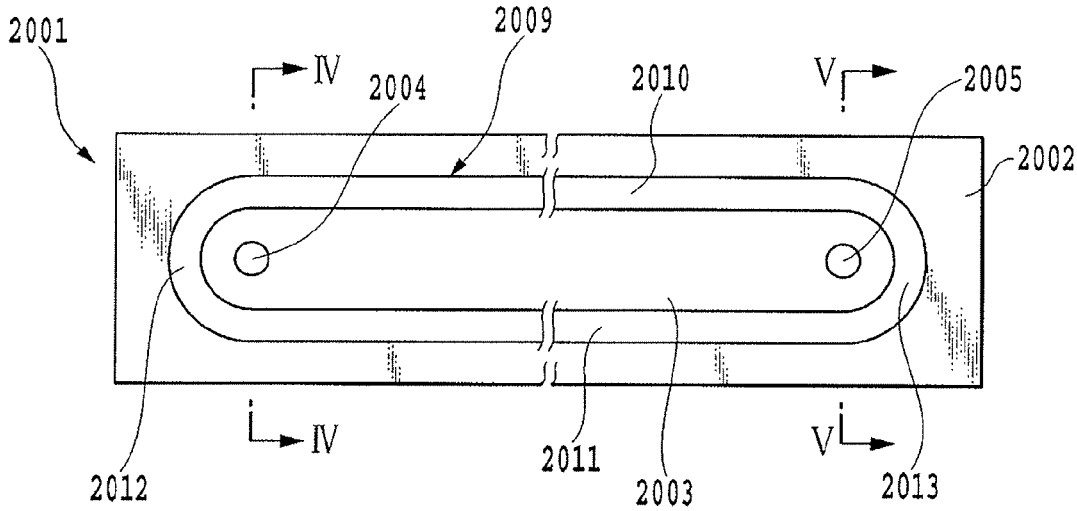
FIG. 4 is a front view of the liquid retention member shown in FIGS. 1 and 2.

As shown in FIG. 4, the liquid retention member 2001 includes a space creating base 2002 and an annular contact member 2009 provided on one surface of the space creating base 2002 in a protruding manner. In the space creating base 2002, a concave portion 2003, a bottom portion of which has a circular-arc cross section, is formed in the middle thereof along the longitudinal direction. Each straight portion of the contact member 2009 is fixedly attached to the space creating base 2002 along the edge portion of the concave portion 2003, and each circumferential portion thereof is fixedly attached to the space creating base 2002 so as to run from one edge portion to the other edge portion via the bottom portion. In this way, when abutting on the application roller 1001, the contact member 2009 of the liquid retention member 2001 can abut thereon in conformity with the shape of the circumferential surface of the application roller, which realizes the abutting with a uniform pressure.

As described above, with regard to the liquid retention member in this embodiment, the seamless contact member 2009 formed in one body is caused to abut on the outer circumferential surface of the application roller 1001 consecutively with no space therebetween by the bias force of the spring member 2006. As a result, the liquid retention space S becomes a substantially closed space defined by the contact member 2009, one surface of the space creating base and the outer circumferential surface of the application roller 1001, and the liquid is retained in this space. Thus, while the rotation of the application roller 1001 is stopped, the contact member 2009 and the outer circumferential surface of the application roller 1001 can keep a fluid-tight state, and can surely prevent the liquid from leaking out. On the other hand, when the application roller 1001 rotates, as described later, the application liquid can go past the contact member 2009 in such a manner as to pass through the interface between the outer circumferential surface of the application roller 1001 and the contact member 2009. "While the application roller 1001 is stopped, the outer circumferential surface thereof and the contact member 2009 are in a fluid-tight state" means that, as described above, the liquid is not allowed to pass through the boundary between the inside and the outside of the space. In this case, the abutting condition of the contact member 2009 includes a condition where the contact member 2009 abuts on the outer circumferential surface of the application roller 1001 with a film of the liquid, which is formed by the capillary action, interposed therebetween, as well as a condition where the contact member 2009 directly abuts on the outer circumferential surface of the application roller 1001.

Figure 7:
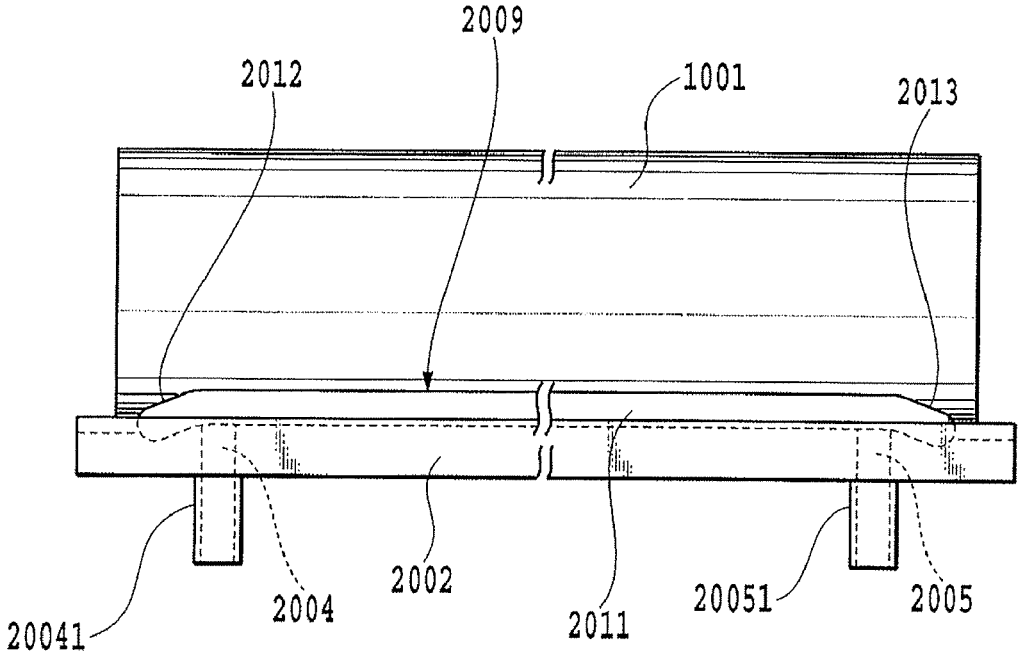
FIG. 7 is a plan view of the liquid retention member shown in FIG. 4.
Figure 8:
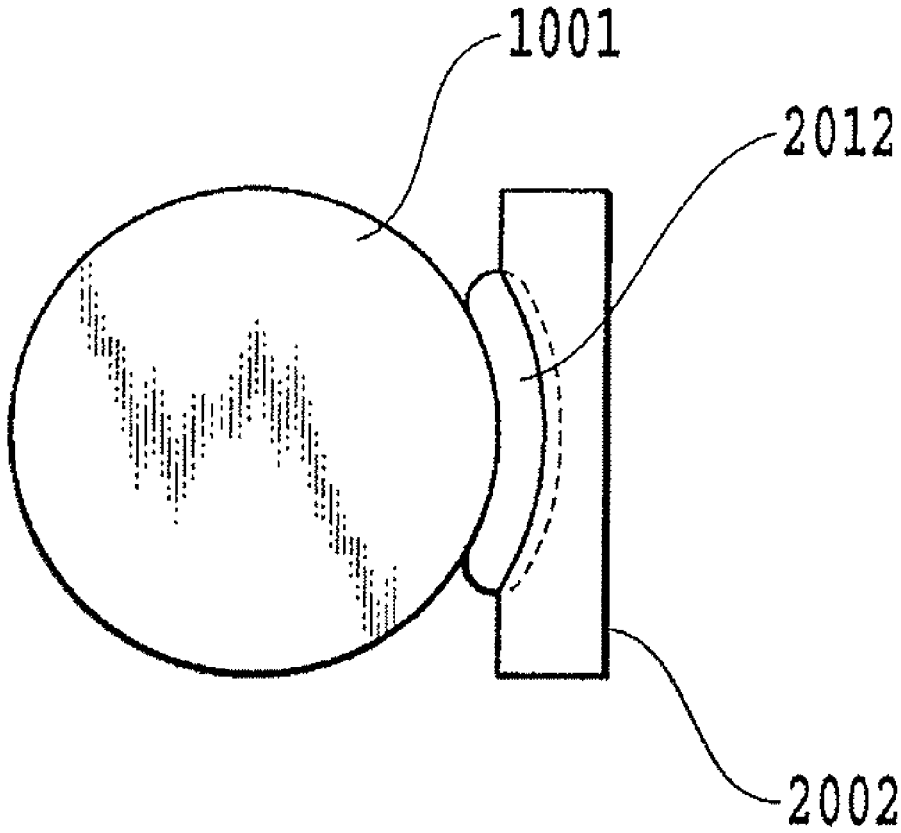
FIG. 8 is a left side view showing a state where a contact portion of the liquid retention member shown in FIG. 4 is allowed to abut on the liquid application roller.
Figure 9:
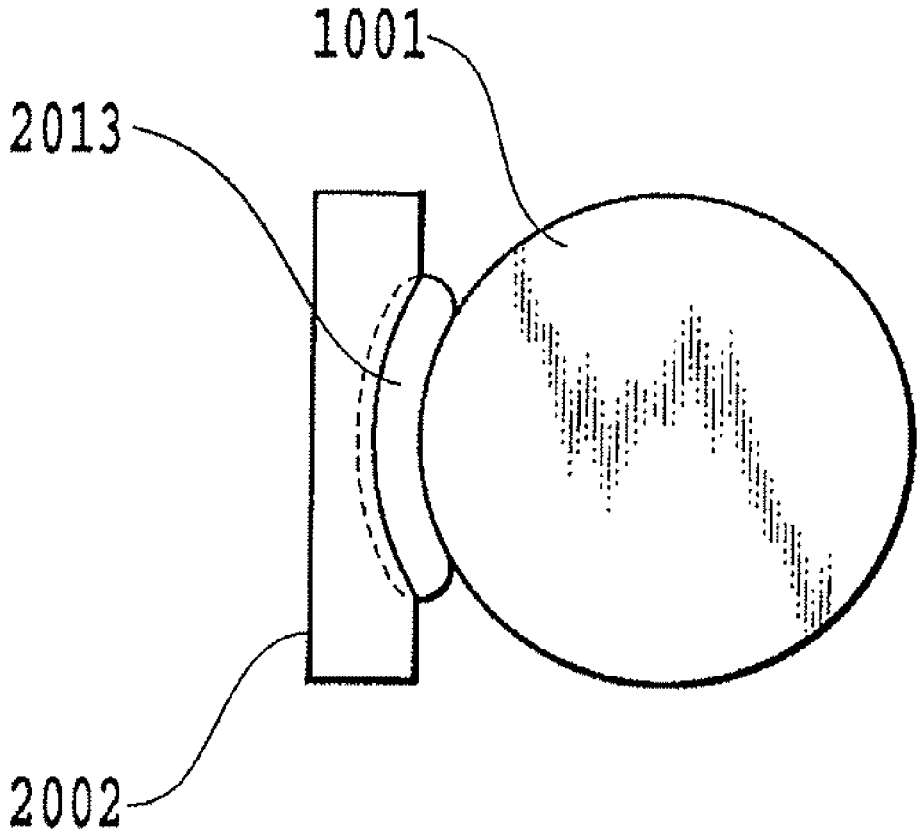
FIG. 9 is a right side view showing a state where the contact portion of the liquid retention member shown in FIG. 4 is allowed to abut on the liquid application roller.

The left and right end portions of the contact member 2009 in the longitudinal direction have a gently curved shape when viewed from any one of the front thereof (FIG. 4), the top thereof (FIG. 7), and a side thereof (FIGS. 8 and 9). As a result, even when the contact member 2009 is allowed to abut on the application roller 1001 with a relatively high pressure, the whole contact member 2009 is elastically deformed substantially uniformly, and local large deformation does not occur. Thus, the contact member 2009 abuts on the outer circumferential surface of the application roller 1001 consecutively with no space therebetween, and can create the substantially closed space, as shown in FIGS. 7 to 9.

Figure 5:
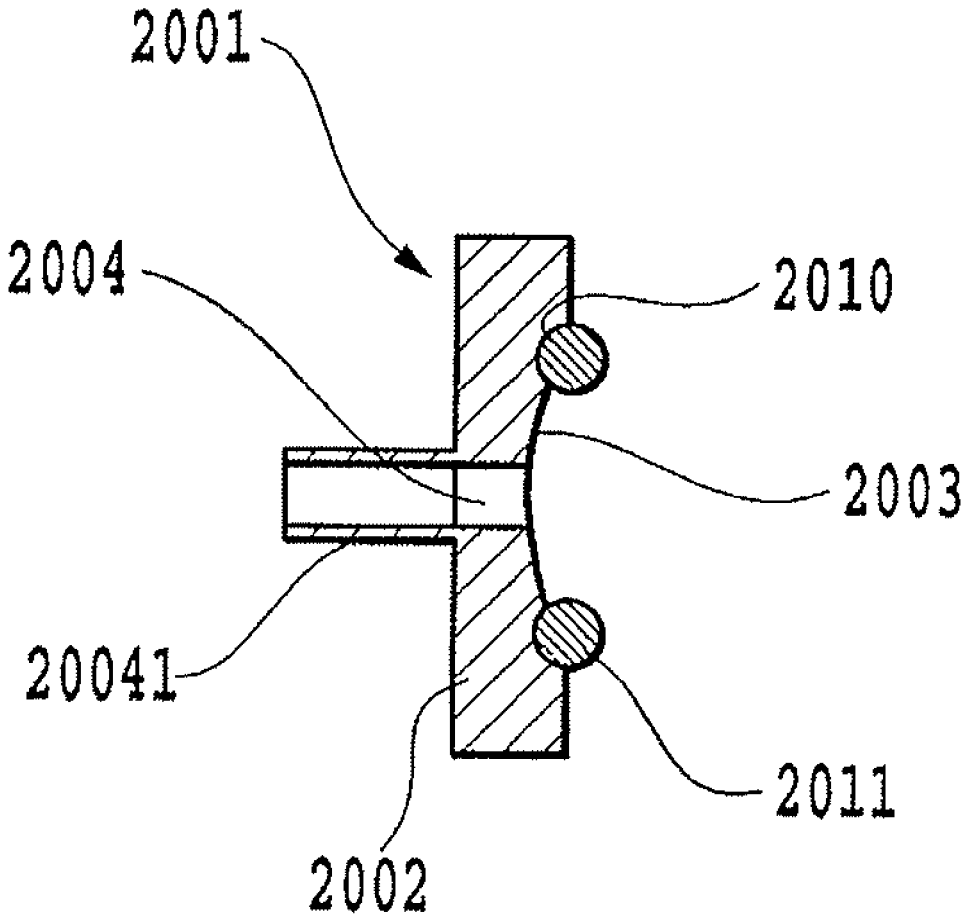
FIG. 5 is an end view showing an end obtained by cutting the liquid retention member shown in FIG. 4 along the line IV-IV.
Figure 6:
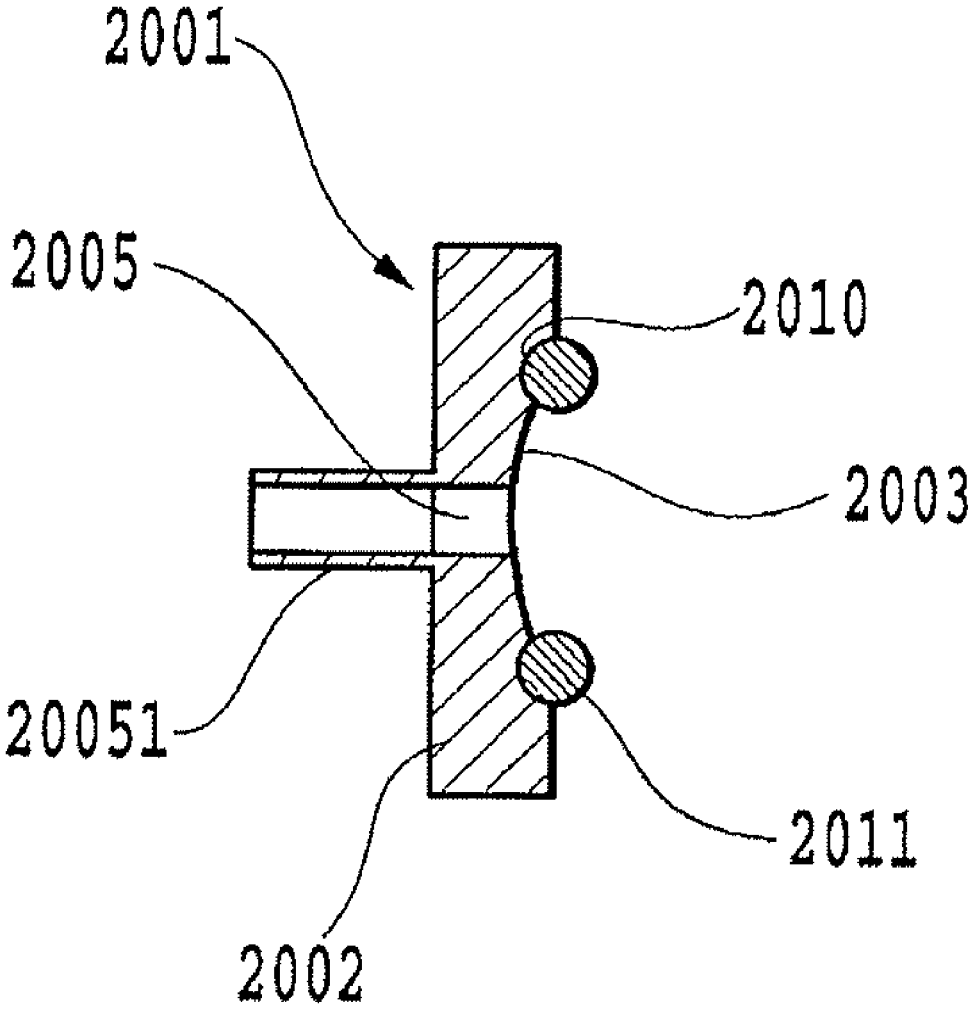
FIG. 6 is an end view showing an end obtained by cutting the liquid retention member shown in FIG. 4 along the line V-V.

On the other hand, as shown in FIGS. 4 to 6, the space creating base 2002 is provided with a liquid supply port 2004 and a liquid collection port 2005 in the region surrounded by the contact member 2009, each port being formed by making a hole penetrating the space creating base 2002. These ports communicate with cylindrical joint portions 20041 and 20051, respectively, which are provided on a back side of the space creating base in a protruding manner. The joint portions 20041 and 20051 are in turn connected to the below-described liquid channel 3000. In this embodiment, the liquid supply port 2004 is formed near one end portion (the left end portion in FIG. 4) of the region surrounded by the contact member 2009, and the liquid collection port 2005 is provided near the other end portion (the right end portion in FIG. 4) of the same region. The liquid supply port and the liquid collection port are not limited by the above configuration, and may be formed at any location in the space creating base. In addition, the number of the liquid supply ports and the number of the liquid collection ports may be arbitrary. The liquid supply port 2004 is used to supply, to the above-described liquid retention space S, the application liquid supplied from the liquid channel 3000. The liquid collection port 2005 is used to allow the liquid in the liquid retention space S to flow out to the liquid channel 3000. By supplying the liquid and allowing the liquid to flow out, the application liquid is caused to flow from the left end portion to the right end portion in the liquid retention space S.

(Application Liquid Channel)

Figure 12:
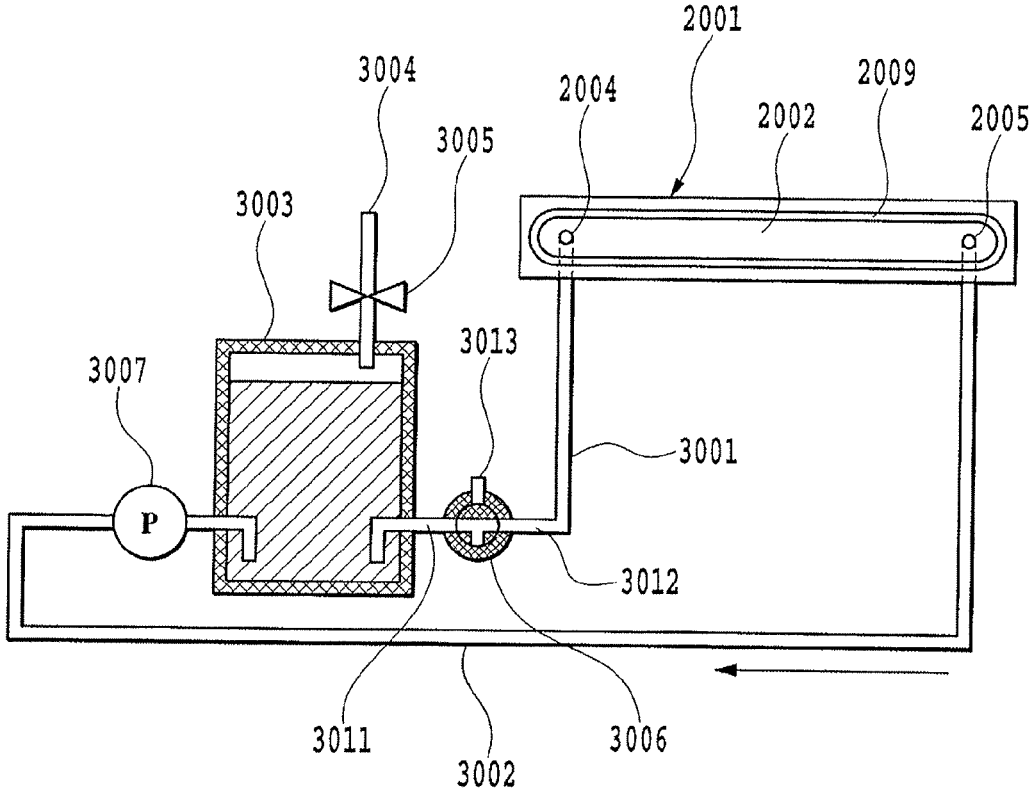
FIG. 12 is a diagram showing a schematic configuration of a liquid channel of the liquid application device in the embodiment of the present invention.

FIG. 12 is an explanatory diagram showing a schematic configuration of the liquid channel 3000 connected to the liquid retention member 2001 of the application liquid supply means.

The liquid channel 3000 has a first channel 3001. The first channel 3001 connects the liquid supply port 2004 of the space creating base 2002, which is a component part of the liquid retention member 2001, to a storage tank 3003, which stores the application liquid. In addition, the liquid channel 3000 has a second channel 3002 which connects the liquid collection port 2005 of the space creating base 2002 to the storage tank 3003. This storage tank 3003 is provided with an atmosphere communication port 3004, and the atmosphere communication port 3004 is provided with an atmosphere communication valve 3005 switching between the state in which the storage tank 3003 communicates to the atmosphere and another state in which the tank 3003 is cut off from the atmosphere. Furthermore, in the storage tank 3003, a remaining application liquid sensor (not shown) is provided as means for detecting the remaining amount of the application liquid in the storage tank 3003. The remaining application liquid sensor informs a detection section 5006, which is described later, of shortage of the application liquid. Moreover, a switching valve 3006 is provided in the first channel 3001. The switching valve 3006 switches between the state in which the first channel 3001 communicates to the atmosphere and the state in which the first channel 3001 is cut off from the atmosphere. A pump 3007 is connected to the second channel 3002. The pump 3007 is used to force the application liquid and air in the liquid channel 3000 to flow in a direction as required. In this embodiment, the pump 3007 causes the liquid to flow in the direction from the first channel 3001, through the liquid retention space S, to the second channel 3002.

Additionally, in this specification, the state of "the application liquid being insufficient" includes a state in which no application liquid is attached to the surface of the application roller or to the counter roller at all, or a state in which the application liquid is not attached to the entire surface thereof, that is, a state in which the application liquid is non-uniformly attached to the surface. Also included is a case in which the remaining amount of the application liquid in the storage tank is less than a designated amount even if the application liquid is attached to the entire surface of the application roller. In other words, included in the state of insufficiency is the state in which the application liquid which remains in the storage tank is not enough to be applied to a whole page of the recording medium to be recorded. Accordingly, the aforementioned designated amount of the liquid corresponds to at least the necessary amount, or an amount more than necessary, of the application liquid to be applied to a whole page of the recording medium to be recorded.

As described above, different values are applied as the designated values to the recording media of different sizes. For this reason, designated value information on the designated value corresponding to each size of recording medium may be stored in a ROM 5002. In this case, the designated value, which is appropriate for the size of the recording medium to be recorded, may be used by reading, from the ROM 5002, the information on the designated value corresponding to the size of the recording medium to be recorded, in a step of detecting the remaining amount of application liquid, which is to be described later.

Alternatively, the designated value to be used in the step of detecting the remaining amount of application liquid may be fixed to the designated value corresponding to the maximum recordable size.

In this embodiment, the first channel 3001 and the second channel 3002 are formed of circular tubes. The opening formed at an end of each tube is located at, or near, the bottom of the storage tank 3003. With this arrangement, the application liquid in the storage tank 3003 can be consumed almost completely.

Figure 18:
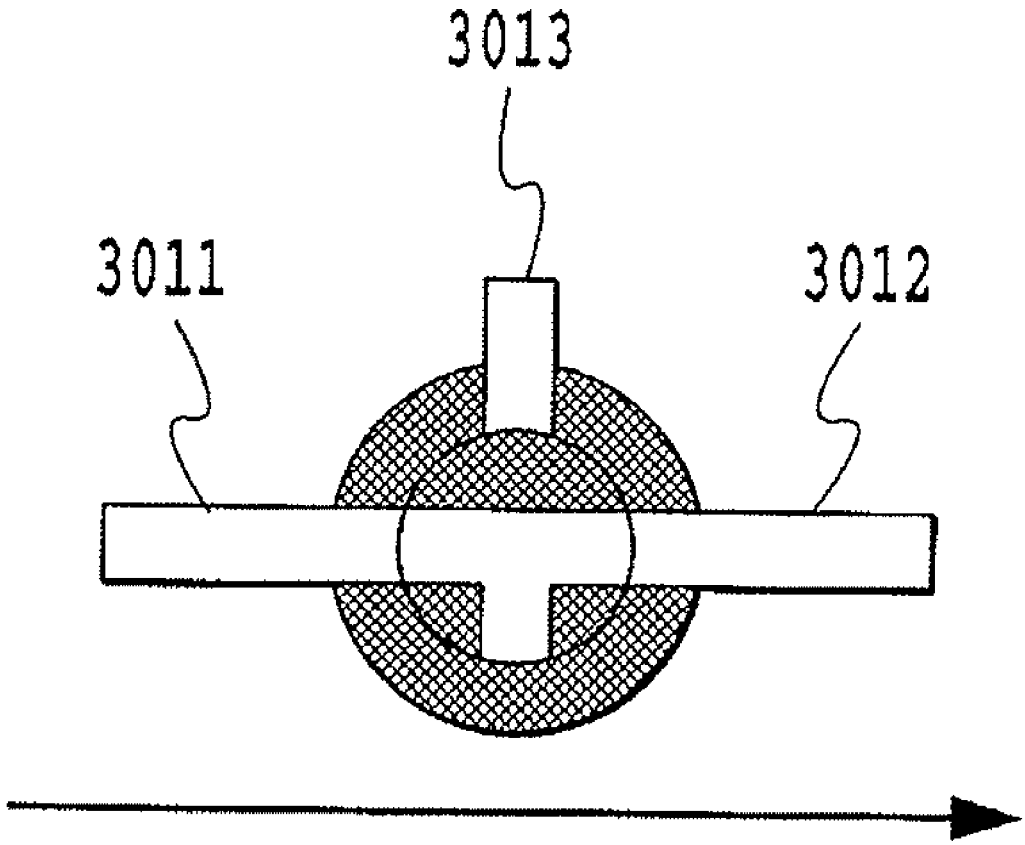
FIG. 18 is a diagram showing a state where tubes 3011 and 3012 are allowed to communicate with each other by a three-way valve 3006.
Figure 19:
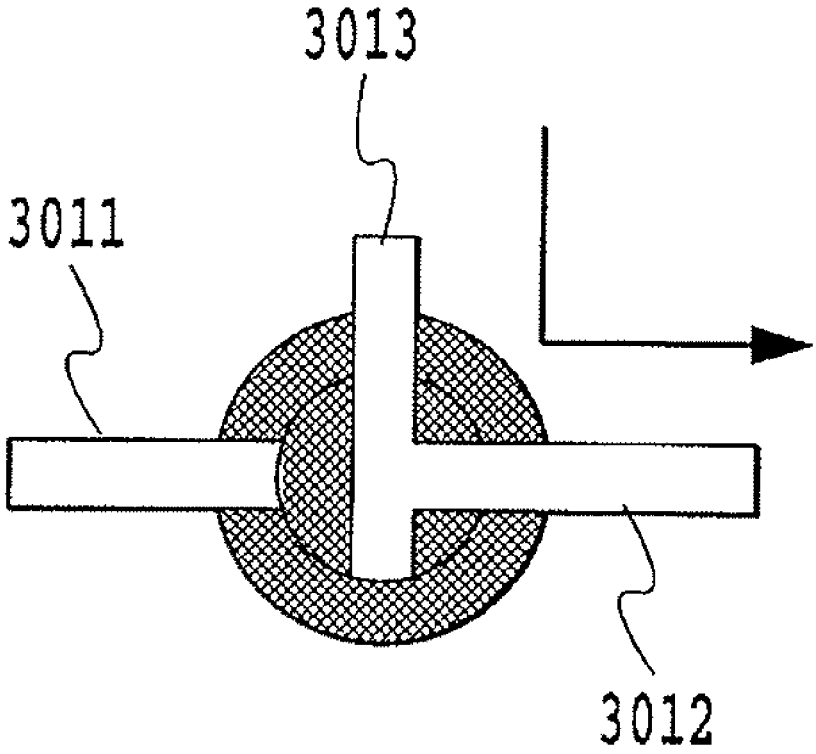
FIG. 19 is a diagram showing a state where the tube 3012 and an atmosphere communication port 3013 are allowed to communicate with each other by the three-way valve 3006.

Moreover, various kinds of valves can be used for a switching valve 3006, as long as the valve can switch between the state in which the first channel 3001 communicates to the atmosphere and the state in which the first channel 3001 is cut off from the atmosphere. A three-way valve as shown in FIG. 12 is used in this embodiment. The three-way valve 3006 has three ports communicating to one another. The three-way valve 3006 can allow two of these three ports to selectively communicate to each other. With this structure, the three-way valve 3006 can select any two among a storage-tank side tube 3011, a liquid-retention-member side tube 3012 and an atmosphere communication port 3013, the three being in the first channel 3001, and can allow the selected two to communicate to each other. In practice, the switching of this three-way valve 3006 allows for the selective switching between a connection state in which the tubes 3011 and 3012 are allowed to communicate to each other and a connection state in which the tube 3012 and the atmosphere communication port 3013 are allowed to communicate to each other. This makes it possible to selectively supply, to the liquid retention space S, the application liquid in the storage tank 3003 or the air taken in from the atmosphere communication port 3013. The liquid retention space S is created by the liquid retention member 2001 and the application roller 1001. Specifically, when the tubes 3011 and 3012 communicate to each other as shown in FIG. 18, the application liquid in the storage tank 3003 will be supplied to the liquid retention space S. On the other hand, when the tube 3012 and the atmosphere communication port 3013 communicate to each other as shown in FIG. 19, the air taken in from the atmosphere communication port 3013 is supplied to the liquid retention space S. The switching of the three-way valve 3006 is performed in accordance with a control signal from the control unit 5000 described later, and the filling or the supplying of the application liquid is carried out.

(Control System)

Figure 13:
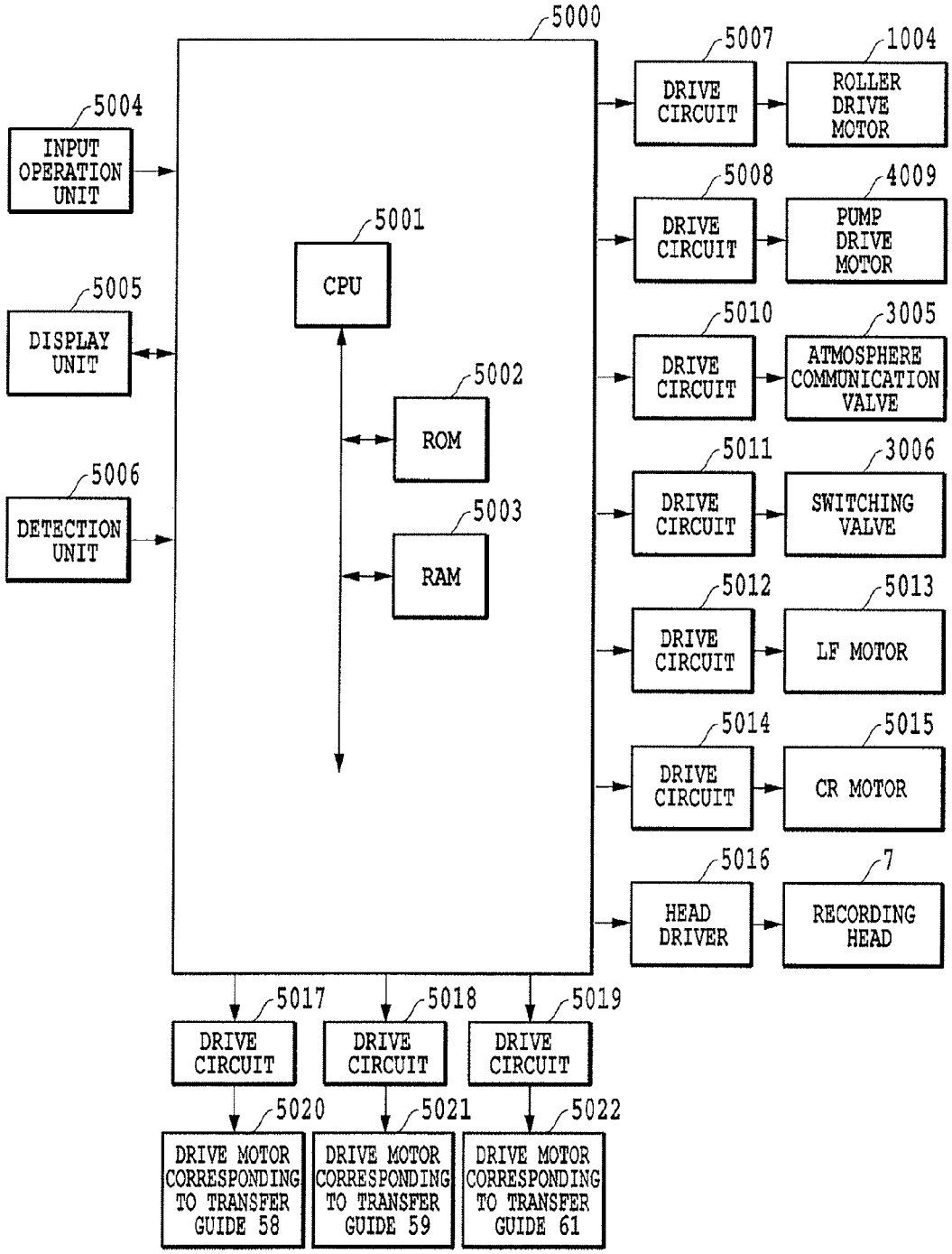
FIG. 13 is a block diagram showing a schematic configuration of a control system in the embodiment of the present invention.

FIG. 13 is a block diagram showing a schematic configuration of a control system in the inkjet printer of this embodiment.

Reference numeral 5000 in FIG. 13 is a control unit for controlling the whole liquid application apparatus. This control unit 5000 includes a CPU 5001 that executes various processing, such as computation, control, and determination. Moreover, the control unit 5000 includes a ROM 5002 that stores a control program for processing to be described later in FIGS. 14 and 21. A RAM 5003 that temporarily stores inputted data and data generated during processing by the CPU 5001.

An input operation unit 5004 and a display unit 5005 are connected to the control unit 5000. The input operation unit 5004 includes a keyboard or various switches with which a designated command, data or the like is inputted. The display unit 5005 displays a variety of information, such as input state, settings, or the like, of the liquid application device. In addition, a detection unit 5006 is connected to the control unit 5000. The detection unit 5006 includes sensors for detecting the position of an application medium, the operation condition of each portion, or the like, and also includes a remaining application liquid sensor. Moreover, a roller drive motor 1004, a pump drive motor 4009, and actuators of the atmosphere communication valve 3005 and of the switching valve 3006 are connected to the control unit 5000 via drive circuits 5007, 5008, 5010 and 5011, respectively. Furthermore, drive motors 5020 to 5022, which drive transfer guides 58, 59, 61, respectively, are connected to the control unit 5000 via drive circuits 5017 to 5019, respectively.

The CPU 5001 controls the driving of each element of the application mechanism, as described above, in accordance with a program of a procedure described later in FIGS. 14 and 21. The CPU 5001 also controls the driving of an LF motor 5013, that of a CR motor 5015 and that of the recording head 7, which are involved in the recording mechanism, via drive circuits 5012 and 5014, and a head driver 5016, respectively. The CPU 5001 further controls the drive motors 5020 to 5022 for the transfer guides 58, 59 and 61 via the drive circuits 5017 to 5019, respectively. Specifically, the transfer roller 4, for example, is rotated by the driving of the LF motor 5013, and a carriage on which the recording head 7 is mounted is moved by the driving of the CR motor 5015. The CPU 5001 also controls the ink ejection from the nozzles of the recording head. The CPU 5001 further controls the rotations of the transfer guides 58, 59, and 61 by the driving of the drive motors 5020 to 5022, respectively. By this means, the CPU 5001 controls the switching between the passage with application and the passage without application, and also controls the switching the transfer passages for two-sided printing.

Figure 14:
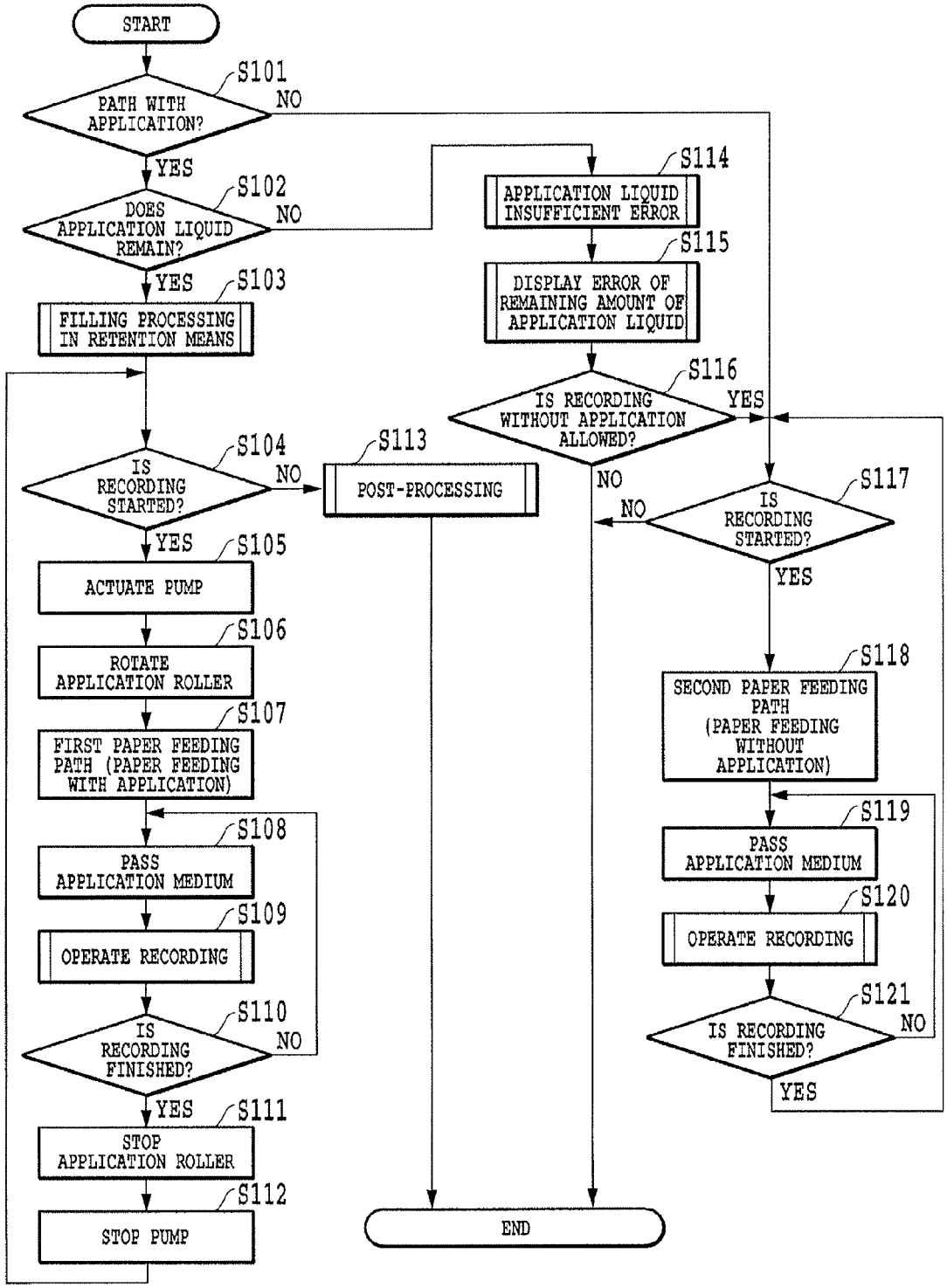
FIG. 14 is a flow chart showing a recording operation sequence in the embodiment of the present invention.

FIG. 14 is a flow chart showing procedures of the liquid application operation and the related recording operation using the inkjet printer of this embodiment.

Once this printer is turned on, the control unit 5000 carries out the following sequences of the application operation and recording operation in accordance with the flow chart shown in FIG. 14.

Determination of Paper Feeding Method

First, at the start of recording, a paper feeding method, that is, a paper feeding passage is selected. In step S101, from the information on paper feeding passage included in a print job transmitted from an image supply apparatus such as a personal computer and the like, it is determined whether the paper feeding passage designated by the user is the passage with application. The image supply apparatus operates as follows, regarding the information on paper feeding passage. A paper feeding passage is selected, as desired by the user, by use of a GUI dialogue on the image supply apparatus. Then, the image supply apparatus attaches paper feeding information on the selected paper feeding passage to the print job.

Note that, in this embodiment, the user selects the paper feeding passage by use of the GUI dialogue on the image supply apparatus. The present invention, however, is not limited to this. For example, with a table, having been prepared in advance, in which an appropriate passage is associated with each type of recording medium, when the user selects a recording medium on the GUI dialogue, a passage appropriate for the selected recording medium may be extracted with reference to the table. At this time, the image supply apparatus attaches paper feeding passage information on the extracted passage to the print job. For instance, in a case where the user selects glossy paper, which is a recording medium unlikely to produce a favorable result by applying the application liquid thereto, the image supply apparatus selects the passage without application with reference to the table, and attaches information, to the print job, indicating that the passage without application is selected.

When it is determined in step S101 that the paper feeding passage is a passage with application (in a case where the passage with application is selected), the processing proceeds to a step of checking the remaining amount of application liquid (step S102). When it is determined in step S101 that the paper feeding passage is a passage without application (in a case where the passage without application is selected), recording without application is carried out with no unnecessary operation of the application mechanism being performed after paper is fed from the paper feeding section 60. "Recording without application" here means that the recording medium is transferred using the passage without application and the recording is carried out by the recording head without applying the application liquid to the recording medium.

In step S102, based on information detected by the remaining application liquid sensor, whether an appropriate amount of the application liquid remains in the storage tank 3003, namely, whether the amount of application liquid stored in the storage tank 3003 is insufficient, is determined. The remaining application liquid sensor just has to detect the amount of application liquid in the storage tank 3003. For this reason, a sensor for managing a liquid level, for example, may be used. In step S102, if the residual amount information on the amount of application liquid detected by the remaining application liquid sensor tells that the amount of application liquid remaining in the storage tank 3003 equals to a designated value or more, it is determined that the application liquid is sufficient. The processing proceeds to step S103 based on the above determination. In step S103, the paper is fed from the paper feeding section 2 via the first transfer passage, a normal application operation is performed, and then recording with application is carried out. "Recording with application" here means that the recording medium is transferred via the passage with application to thereby apply the application liquid to the recording medium, and then recording on the recording medium to which the application liquid has been applied is carried out by the recording head.

In a case where the residual amount information tells that the amount of the application liquid remaining in the storage tank 3003 is less than the designated value, it is determined that the application liquid is insufficient. Based on the above determination, recording operation is controlled so as not to carry out recording with application. Namely, the transfer of recording medium via the passage with application is prohibited. At this time, an error message is displayed on a display section 5005, leading to the feeding of paper via the passage without application, or to the feeding of paper from the paper feeding section 60. After that, whether recording without application using the second transfer passage will be carried out is determined. As described above, when the application liquid is insufficient, recording with application is prohibited in this embodiment. In short, what is important is that, when the amount of the application liquid remaining in the storage tank 3003 equals the designated value or more, recording with application is carried out, and alternatively, when the amount of the application liquid remaining in the storage tank 3003 is less than the designated value, recording with application is not carried out.

The following is the explanation of recording with application.

Filling Step

When it is determined in step S102 that the application liquid is sufficient in step S102, the filling of the application liquid into the liquid retention space S is executed in step S103. In this filling step, first of all, the atmosphere communication valve 3005 of the storage tank 3003 is operated to be opened to the atmosphere, and, at the same time, the pump 3007 is driven during a certain period of time. With this operation, in a case where the liquid retention space S, and the channels 3001 and 3002 are not filled with the application liquid, the air in these portions is sent to the storage tank 3003 using the pump 3007, and is discharged to the atmosphere. At the same time, the application liquid is filled in these portions. In a case where these portions are already filled with the application liquid, the application liquid in these portions flows, and an application liquid having a proper concentration and viscosity is supplied. With this initial operation, the application liquid has been supplied to the application roller 1001, which can apply the liquid to the recording medium.

Application Step

Figure 10:
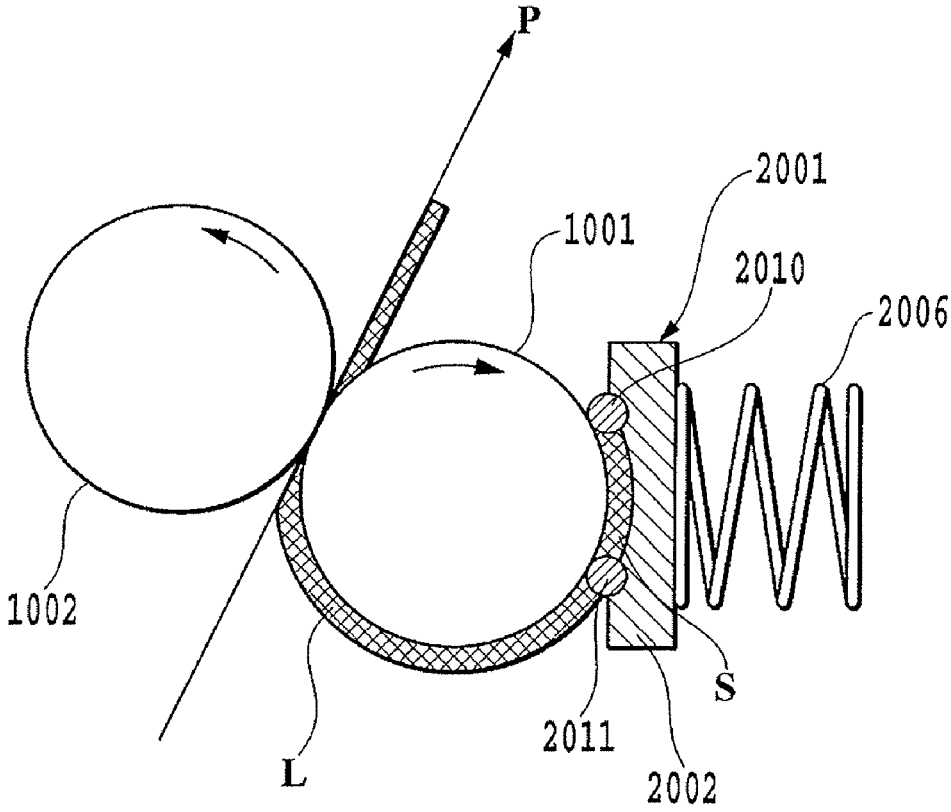
FIG. 10 is a longitudinal sectional view showing a state where a liquid retention space created by the liquid retention member and the application roller is filled with an application liquid, and the liquid is applied to an application medium as the application roller rotates in the embodiment of the present invention.
Figure 11:
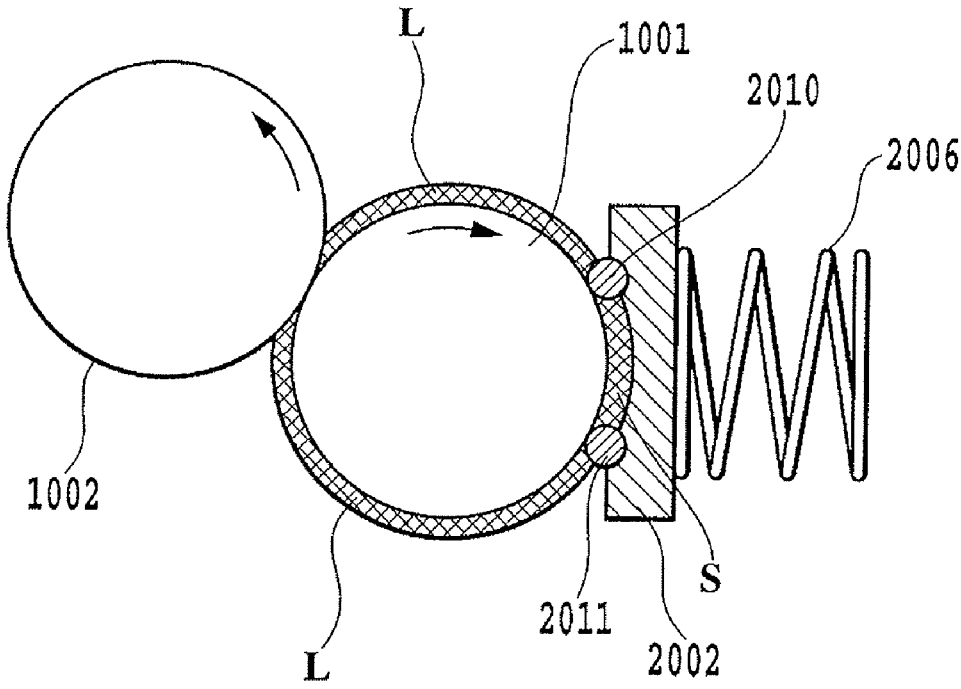
FIG. 11 is a longitudinal sectional view showing a state where the liquid retention space created by the liquid retention member and the application roller is filled with the application liquid, and the application roller is rotated with no application medium present in the embodiment of the present invention.

Here, when a recording start command is inputted (step 104), the pump 3007 begins to operate again (step S105), and the application roller 1001 starts to rotate clockwise as shown by the arrows in FIGS. 10 and 11 (step S106). Then, as illustrated in FIG. 10, with this rotation of the application roller 1001, application liquid L filled in the liquid retention space S overcomes the pressing force of the contact member 2009 of the liquid retention member 2001 against the application roller 1001. The application liquid L sneaks through the interstice between the application roller 1001 and a lower edge portion 2011 of the contact member 2009. The application liquid L, which has sneaked therethrough, is attached to the circumferential surface of the application roller 1001 to form a coating film. The application liquid L attached to the application roller 1001 is sent to the portion where the application roller 1001 and the counter roller 1002 are in contact with each other with the recording medium P lying in between.

Next, in a case where each of the transfer guides 58, 59, and 61 does not establish a required passage, the passage in connection with each of the transfer guides is established, as is required. Specifically, regarding the transfer guide 58, in a case where the paper feeding section 2 and the transfer passage 62*a* are not connected to each other, the drive motor is driven to turn the transfer guide 58 about the pivot shaft 58*a* to make the paper feeding section 2 be connected to the transfer passage 62*a*. Moreover, regarding the transfer guide 59, in a case where the passage leading to the transfer roller 4 from the application roller 1001 is not established, the drive motor is driven to turn the transfer guide 59 about the pivot shaft 59*a*. Thus, the passage leading to the transfer roller 4 from the application roller 1001 is established. Furthermore, regarding the transfer guide 61, in a case where the passage leading to the transfer roller 4 from the application roller 1001 is not established, the drive motor is driven to turn the transfer guide 61 about the pivot shaft 61*a*. As a result, the passage leading to the transfer roller 4 from the application roller 1001 is established. In this way, the first transfer passage is established (step S107).

Subsequently, the recording medium feeding mechanism 1006 transfers a recording medium to the interstice between the application roller 1001 and the counter roller 1002, and the recording medium is inserted into the interstice between these rollers (step S108).

During the transfer, the application liquid L applied to the circumferential surface of the application roller 1001 is transferred from the application roller 1001 to the recording medium P as shown in FIG. 10. Needless to say, the means for feeding the recording medium to the interstice between the application roller 1001 and the counter roller 1002 is not limited to the above feeding mechanism. For example, manual feeding means may be used singly, or together with an ancillary guide member designed for that purpose.

In FIG. 10, the cross hatched part indicates the application liquid L. It should be note that, in this figure, the thicknesses of the layers of the application liquid on the application roller 1001 and the application medium P is depicted relatively larger than the actual thickness, for the purpose of the clear illustration of the state of the application liquid L shown at the time of the application.

In this way, the part of an application medium P to which the liquid has been applied is transferred in the direction indicated by the arrow by the transferring force of the application roller 1001, and, at the same time, the part of the application medium P to which the liquid is not applied is transferred to the contact area between the application medium P and the application roller 1001. By performing this operation continuously or intermittently, the application liquid is applied to the entire surface of the application medium.

Incidentally, FIG. 10 shows an ideal state of application where all the application liquid L, which has passed the contact member 2009 and has stuck to the application roller 1001, has been transferred to the application medium P. In fact, however, all the application liquid L having stuck to the application roller 1001 is not always transferred to the application medium P. Specifically, in many cases, when the transferred application medium P moves away from the application roller 1001, the application liquid L also sticks to the application roller 1001, and thus remains on the application roller 1001. The remaining amount of the application liquid L on the application roller 1001 varies depending on the material of the application medium P and the microscopic irregularities of the surface. In a case where the application medium is a plain paper, the application liquid L remains on the circumferential surface of the application roller 1001 after the application operation.

FIGS. 15 to 17 are explanatory diagrams for explaining an application process proceeding between the application surface and the surface of the medium in a case where the medium P is a plain paper. In these figures, the liquid is expressed by the regions filled in with black.

FIG. 15 shows a state of the application roller 1001 and the counter roller 1002 in an area upstream of the nip area thereof. In this figure, the liquid has stuck to the application surface of the application roller 1001 in such a manner that the liquid thinly covers the microscopic irregularities of the application surface.

FIG. 16 shows a state of both of the surface of the plain paper, which is the medium P, and the application surface of the application roller 1001 in the nip area of the application roller 1001 and the counter roller 1002. In this figure, the convex portions of the surface of the plain paper, which is the medium P, abuts on the application surface of the application roller 1001, and, from the abutting portions, the liquid instantly permeates into or sticks on the surface fibers of the plain paper, which is the medium P. The liquid which has stuck to the part of the application surface of the application roller 1001, which part does not abut on the convex portions of the surface of the plain paper, remains on the application surface of the application roller 1001.

FIG. 17 shows a state of the application roller 1001 and the counter roller 1002 in an area downstream of the nip area thereof. This figure shows a state where the medium and the application surface of the application roller 1001 have been completely separated from each other. The liquid sticking to those parts of the applying surface of the application roller 1001 which do not contact with the convex portions on the surface of the plain paper remains on the applying surface. The liquid on the contacting parts also remains with very small amount on the application surface.

The application liquid remaining on the application roller 1001 overcomes the pressing force of the contact member 2009 of the liquid retention member 2001 against the application roller 1001, passes through the interface between the application roller 1001 and an upper edge portion 2010 of the contact member 2009, and is brought back into the liquid retention space S. The returned application liquid is mixed with the application liquid filled in the liquid retention space S.

As shown in FIG. 11, also in a case where the application roller 1001 is rotated when there is no application medium, the returning operation of the application liquid is similarly performed. Specifically, the application liquid stuck to the circumferential surface of the application roller 1001 by rotating the application roller 1001 passes through the interface of the contact area between the application roller 1001 and the counter roller 1002. After this, the application liquid is distributed between the application roller 1001 and the counter roller 1002, and remains on the application roller 1001. The application liquid L sticking to the application roller 1001 passes through the interface between the upper edge portion 2010 of the contact member 2009 and the application roller 1001, enters the liquid retention space S, and is mixed with the application liquid filled in the liquid retention space S.

Recording Step

After the aforementioned application step, the recording operation is performed onto the recording medium to which the application liquid has been applied over the part to which the application is required (step S109). Specifically, the recording head 7 is made to scan the recording medium P which is fed by a designated amount each time by the transfer roller 4. Ink is ejected from the nozzles in accordance with the recorded data during this scanning, and the ink adheres to the recording medium to form dots. This adhering ink, which reacts with the application liquid, makes it possible to improve density and to prevent bleeding. Recording onto the recording medium P is made by repeating the transfer of the recording medium and the scanning of the recording head, as described above. The recording medium onto which the recording has been completed is delivered onto the delivery tray 10.

In other words, the application roller performs a designated amount of rotations intermittently to apply the liquid to different areas of the recording medium, sequentially. At the same time, the transfer roller, which transfers the recording medium, performs a designated amount of rotations intermittently in the same way. Thus, recording is sequentially performed on different areas of the recording medium where ink is ejected. As a result, when ink is ejected onto a first area of recording medium at the downstream side in its transfer direction to carry out recording, the application roller performs application onto a second area of the recording medium at the upstream side in its transfer direction. In this case, the amount of intermittent transfer by the application roller is the same as that by the transfer roller. In this configuration, regarding the transfer passage for transferring the recording medium to which the liquid has been applied to the position facing the recording head, the length of this transfer passage leading to the recording head from the application roller is shorter than the maximum length of the recording medium usable in the recording apparatus.

In this embodiment, along with the application of the liquid to a recording medium, the recording is performed sequentially onto the part of the recording medium to which the application has been completed. In other words, in this embodiment, the length of the transfer passage from the application roller to the recording head is shorter than the length of the recording medium, and, when the part of the recording medium to which the liquid has been applied reaches the scanning region of the recording head, the application to a different part of recording medium is performed by the application mechanism. The liquid application and the recording are sequentially performed in different parts of recording medium every time the recording medium is fed by a designated amount. However, as another embodiment, the method of application and recording described in Japanese Patent Application Laid-open No. 2002-96452 A can be a way of applying the present invention to a recording apparatus. The apparatus in Japanese Patent Application Laid-open No. 2002-96452 A performs recording onto a recording medium after application to the recording medium as a whole has been completed. In this configuration, after the liquid is applied to the entire surface of the recording medium by the application roller, the recording medium is transferred to the position facing the recording head and ink is discharged to start recording.

Finishing Step

As mentioned above, when the application and recording operations to the recording medium are executed, determination as to whether the recording step should be finished is next made (step S110). In a case where it is determined in step S110 that the recording step is not to be finished, the processing goes back to step 108. The application operation is repeated until the end of the application step in which the application to the recording medium is performed all over the part to which the application is required. The recording operation is also repeated, corresponding to the application operation. When the recording step is finished, the application roller 1001 is stopped (step S111) and the drive of the pump 3007 is also stopped (step S112). After that, the processing proceeds to step S104. In a case where a new recording start command to the next recording medium is inputted within a designated period of time, the operations in the aforementioned steps S104 to S112 are repeated. In a case where no recording start command is inputted within the designated period of time, post-processing, such as a collection operation for collecting the application liquid in the liquid retention space S and the liquid channels is performed (step S113). Thus, this series of processing is completed.

Collection Operation

In addition, the above collection operation is performed in the following manner. The atmosphere communication valve 3005 and the switching valve 3006 are opened to the atmosphere. The pump 3007 is driven to cause the application liquid in the liquid retention space S and the second channel 3002 to flow into the liquid storage tank 3003.

As described above, in this embodiment, in a case where the period of time during which no recording operation is performed is longer than a designated amount of time, the application liquid is collected from the passage which runs from the liquid-retention-member side tube 3012 to the second channel 3002 and which includes the liquid retention space S (hereinafter also referred to as liquid passage A). Accordingly, even if no recording operation is performed for a long time, the application liquid can be prevented from being volatilized and from being stuck in the liquid retention space S in the liquid passage A. As a result, the application failure caused by the sticking of the application liquid to the contact member 2009 is prevented from occurring.

Furthermore, by carrying out the collection operation, the volatilization of the application liquid from the liquid retention space S can be completely prevented or reduced. Moreover, after the collection operation, the atmosphere communication valve 3005 is closed, and the communication between the first channel 3001 and the atmosphere communication port 3013 is blocked by switching the switching valve 3006. In this way, the storage tank 3003 is cut off from the atmosphere. As a result, it is possible to prevent or reduce the volatilization of the application liquid out of the storage tank 3003. In addition, even if the device tilts while being carried or transported, it is possible to completely prevent the application liquid from flowing out, or to reduce the possibility of this occurrence.

The explanation of the recording without application will be explained below.

In a case where it is determined in step S101 that the paper feeding passage is a passage without application, the recording without application, which will be explained below, is performed without various operations in the application mechanism being performed. Specifically, when a recording start command is inputted (step 117), the second transfer passage is established (S118).

In a case where the transfer guide 59 has not established a required passage in step S118, the required passage related to the transfer guide 59 is established. When the transfer passage 63 and the transfer passage 62*b* are not connected to each other due to the transfer guide 59, the drive motor is driven to turn the transfer guide 59 about the pivot shaft 59*a*. As a result, the transfer passage 63 and the transfer passage 62*b* are connected to establish the second transfer passage.

Subsequently, the paper feeding roller 57 is driven to transfer the recording medium P2 to the second transfer passage, so that the recording medium P2 is inserted into the interstice between the transfer roller 4 and the pinch roller 5 (step S119). The recording operation is performed on the inserted recording medium P2 in the same manner as step S109 (step S120). Once the recording operation onto the recording medium P2 has been executed as mentioned above, determination as to whether the recording step should be finished is next made (step S121). In a case where it is determined in step S121 that the recording step is not finished, processing goes back to the step S119 and the recording operation is repeated until the end of the recording step in which the recording onto the recording medium is performed all over the part to which the recording is required.

On completion of the recording step, the processing proceeds to step S117. In a case where a new recording start command to a next recording medium is inputted within a designated period of time, the operations in the aforementioned steps S117 to S121 are repeated. In a case where no recording start command is inputted within the designated period of time, this processing is completed.

The recording without application is carried out in this way.

Incidentally, in a case where it is determined in step S102 that the application liquid is insufficient, the processing proceeds to step S114. In step S114, it is decided that error display indicating that the application liquid is insufficient is to be performed based on the determination in step S102 that the application liquid is insufficient. In step S115, the display section 5005 performs the error display indicating that the application liquid is insufficient. In a case where the display section 5005 has a display such as a liquid crystal panel, a text indicating error can be displayed on the display. Furthermore, in a case where the display section 5005 includes LED, an error signal may be displayed by turning on the LED. Moreover, in a case where the inkjet recording apparatus includes a speaker, the user may be informed of the error by sound. Still moreover, the error display may be shown on the display of the image supply apparatus.

In this embodiment, it is important to have the user recognize that the application liquid in the storage tank is insufficient. For this reason, for example, an error notification is provided to the user. The error notification may be provided by any visual or auditory means. Note that, in this specification, "notifying an error" indicates that letting the user be informed of the error, which includes a case in which informing the user of the error by displaying on the display, lighting, blinking, a warning sound, and the like.

In step S116, determination is made as to whether the user has decided to perform recording without application. When the error display is performed in step S115, the control unit 5000 causes a message, as to whether recording without application should be performed to be displayed, on the GUI dialogue of the image supply apparatus. When the user makes a decision whether recording without application should be performed on the GUI dialogue, decision information related to the above decision is transmitted from the image supply apparatus to the inkjet recording apparatus. In a case where the above decision information is information indicating that recording without application is to be performed, the processing proceeds to step S117 and recording without application is performed. In a case where the above decision information is information indicating that recording without application is not to be performed, the recording without application is not performed and the processing is finished.

As mentioned above, according to this embodiment, in a case where the amount of application liquid remaining in the storage tank 3003 is insufficient, the recording with application is not performed. This makes it possible to prevent or reduce wear of the rollers which are involved in the application of the application liquid, such as the application roller. Accordingly, when the recording with application is carried out, it is possible to perform high quality recording stably for a long time. Moreover, since it is possible to prevent or reduce the wear of the rollers which are involved in the application of the application liquid, such as the application roller, the roller can be made more durable. Thus, since the roller can be used for a long time, it is possible to suppress the running cost.

Moreover, in a case where the application liquid is insufficient, recording with application is not performed. Even in this case, it is possible to switch to another recording method (recording without application) that can maintain quality to some degree. This makes it possible to provide a recoding apparatus that causes no print error nor any trouble even in a case where the application liquid is not applied to the recording medium. In the recording method as being switched to, as mentioned above, the image quality may possibly deteriorate to some degree. This is because recording is carried out without the application liquid being applied to the recording medium which prefers the application of the application liquid. The user, however, can know from the error display which passage is used in recording the output image. Moreover, the error display makes it possible for the user to know the insufficiency of application liquid before determining whether recording without application should be performed. In other words, though the image quality may possibly deteriorate to some degree, the use can choose whether recording should be continued.

Note that, in this embodiment, though the error notification is provided to the user, the error notification to the user can be omitted. However, since the user can know, from the error notification, that the application liquid is insufficient, as mentioned above, it is preferable that the error notification be provided.

Additionally, in this embodiment, after the error notification is provided to the user in step S115, the determination is made in step 116 as to whether the recording without application is acceptable to the user. However, such a configuration that the recording mode is automatically shifted to the recording without application is acceptable. Alternatively, recording can be automatically finished without this determination being made.

The recording without application, which is automatically carried out due to the insufficiency of the application liquid despite the fact that the recording with application is desired, may produce the image with a somewhat lowered quality. However, since the error display is performed, the user can know that the outputted prints include those in which recording without application has been performed onto the recording medium suitable for printing with applying the application liquid thereto.

Moreover, even in a case where the operation is automatically finished after the error display, the user can know, from the above-mentioned error display, that the reason why no print is outputted is an insufficiency of the application liquid.

Additionally, in this embodiment, in the recording without application carried out in the case of a determination that the application liquid is not sufficient, the print mode may be switched to that of the recording without application. Namely, the print mode may be switched to the one that is appropriate for a case in which the application liquid is not applied to the recording medium which prefers the application of the application liquid thereto. The print mode is thus switched from the print mode for the recording with application. This makes it possible to reduce deterioration in image quality in the recording without application of a case where it is determined that the application liquid is insufficient.

In the case of switching the print mode as described above, the amount of ink ejected from the recording head 7 can be made smaller than that in the case of the printing with application in step S120, for example. In addition, in step S120, the rotation speed of the rollers which are involved in the recording operation, such as the transfer roller 4, can be set slower than that of each roller for recording with application. Namely, the print speed in the case of the recording without application may be set slower than that in the case of the recording with application.

As mentioned above, by applying different conditions (controls) from each other to the recording with application and to the recording without application, the quality of images obtained by each recording can be maintained high.

In this embodiment, explanations have been made of the inkjet recording apparatus having two passages, that is, the passage with application and the passage without application. What is important in this embodiment is that, the recording with application, though it is preferred, should not be performed when the amount of application liquid in the storage tank is smaller than the designated amount thereof (liquid application is insufficient). Accordingly, the passage without application is not necessarily provided. Therefore, this embodiment can be applied to the inkjet recording apparatus having only the passage with application.

Note that, in this embodiment, the material of the application roller 1001 is EPDM having rubber hardness of 30 degrees, surface roughness of Ra 1.6 μm and a diameter of 22.19 mm. The material of the counter roller 1002 is aluminum having a mirror-face surface and a diameter of 22.19 mm. Furthermore, the materials of both of the contact members of the liquid retention member 2001 are sliding grade NBR made by NOK, both having rubber hardness of 70 degrees and the same diameter of 3 mm.

Second Embodiment

In the first embodiment, explanations have been given of the mode of the single-sided printing. In this embodiment, explanation is given of the mode of the two-sided printing.

In this embodiment, after an image recoding is performed on a first side (hereinafter simply referred to as "front side") of the recording medium, on which the printing is first performed in the two-sided printing, the recording is performed on a second side (hereinafter simply referred to as "back side"). The determination, as to whether the back side printing should be performed automatically or manually, is made based on the paper feeding passage used in the back side printing. In a case where the back side printing is performed using the passage with application, an automatic two-sided printing function is used to carry out the two-sided printing. In a case where the back side printing is performed using the passage without application, the printing side is manually changed to carry out the two-sided printing. Accordingly, in this embodiment, the recording on the back side is performed, after the following two steps at the time when the recording operation onto the back side is started (in a state that the recording medium is held between the transfer roller 4 and the delivery roller 8). First, "whether the application of the application liquid to the back side of the recording medium is necessary" is determined (step S222). Second, "whether the remaining application liquid is sufficient" is determined (step S223).

Figure 20A:
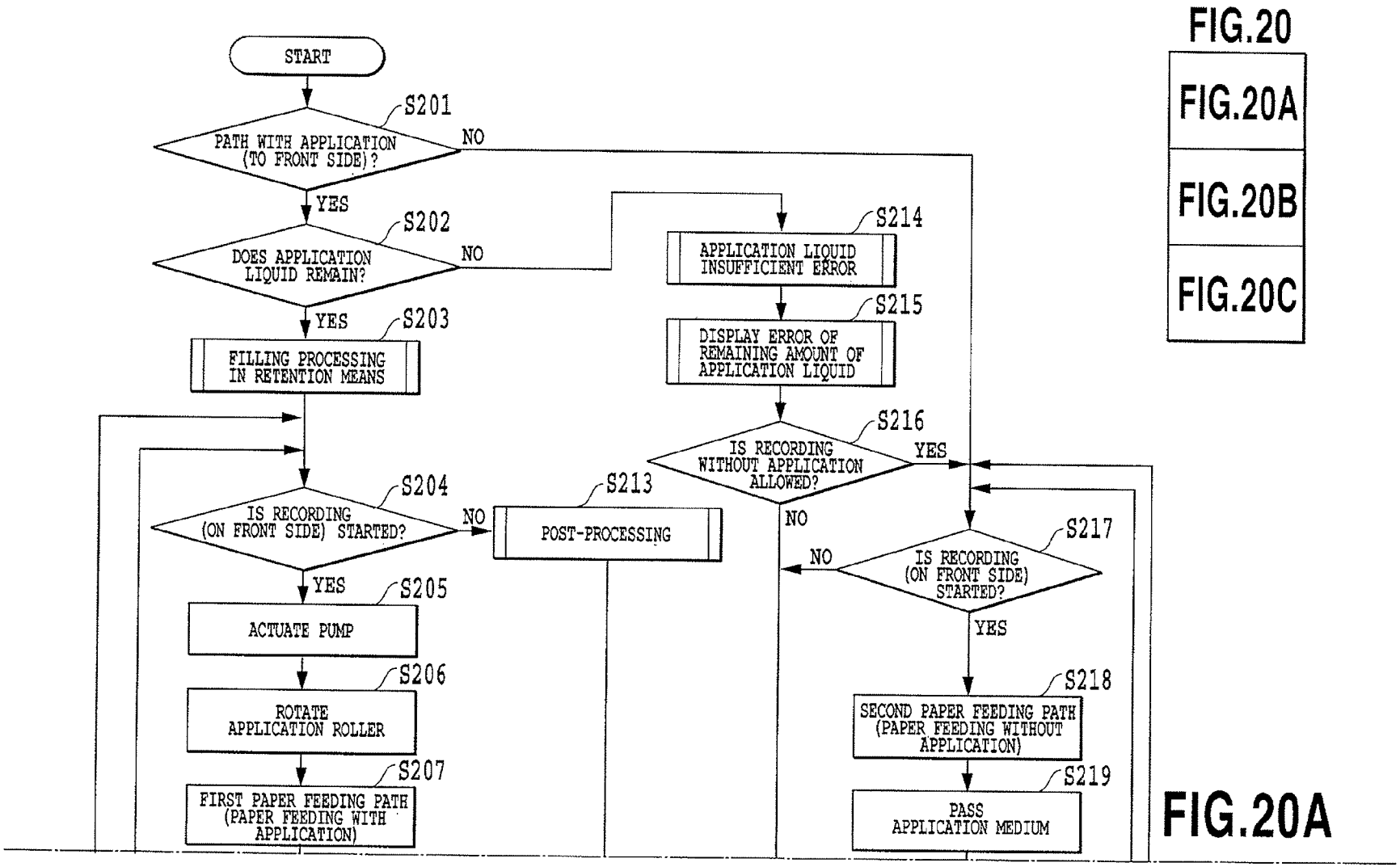
FIG. 20A is a flow chart showing a recording operation sequence in the embodiment of the present invention.
Figure 20B:
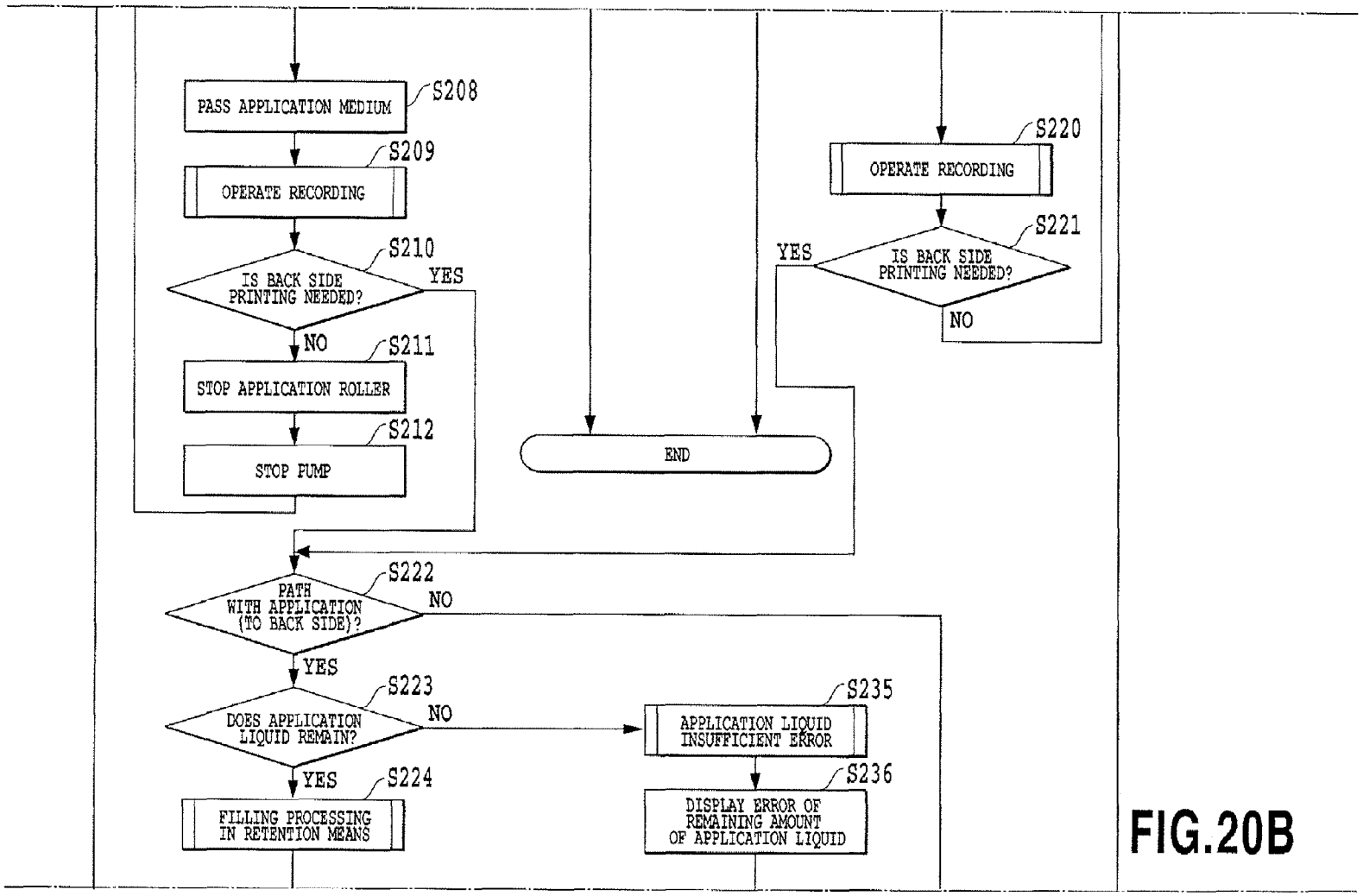
FIG. 20B is a flow chart showing a recording operation sequence in the embodiment of the present invention.
Figure 20C:
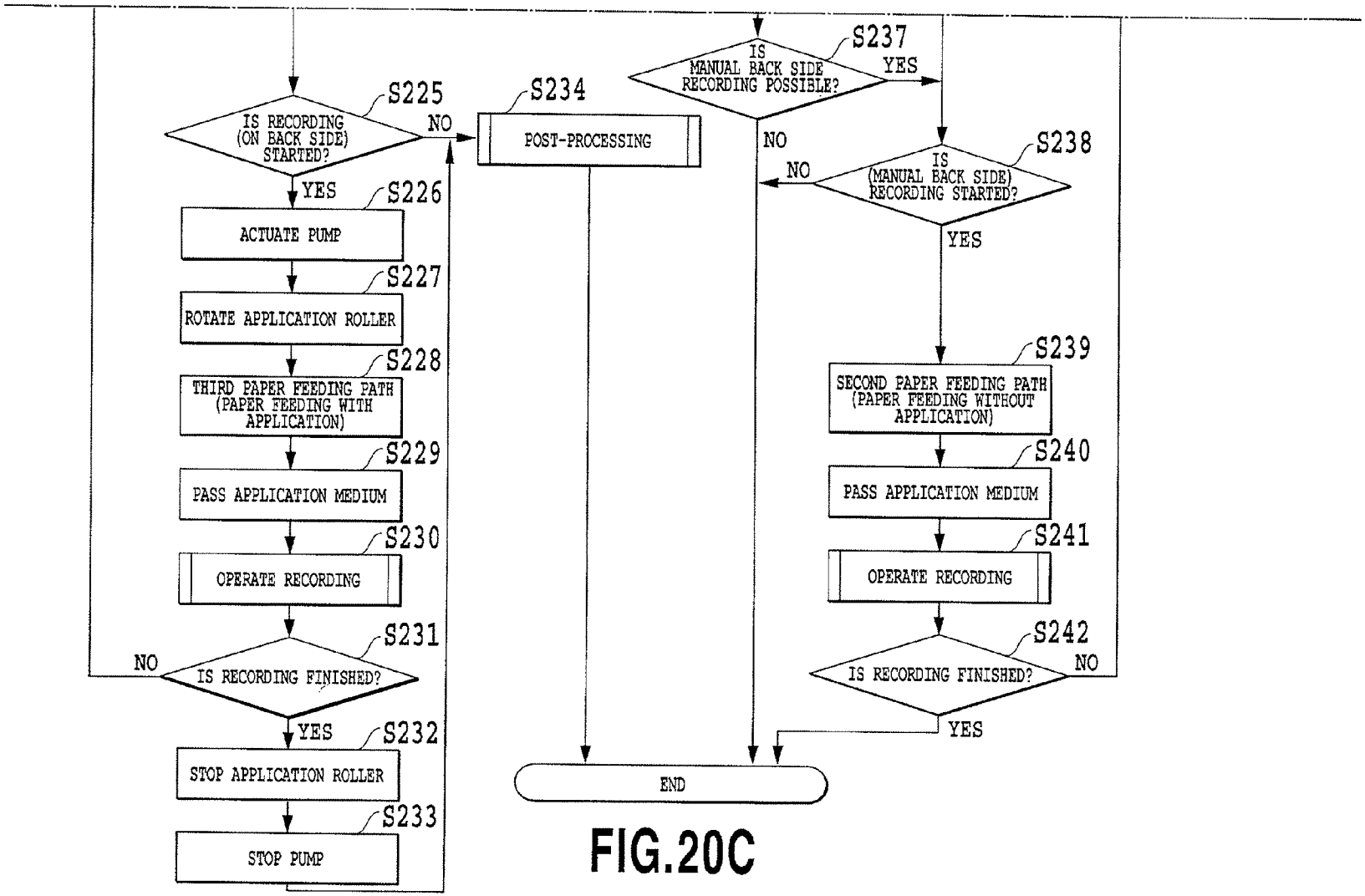
FIG. 20C is a flow chart showing a recording operation sequence in the embodiment of the present invention.

FIGS. 20A to 20C are a flowchart showing a recording operation sequence of two-sided printing in the inkjet recording apparatus according to this embodiment. In FIGS. 20A to 20C, the processing in steps S201 to S209 and the processing in steps S210 to S220 are the same as processing in steps S101 to S109 and the processing in steps S111 to S120 shown in FIG. 14, respectively. Moreover, the processing in steps S222 to S230, the processing in steps S232 to S236, and the processing in steps S239 to S241 are the same as the processing in steps S101 to S109, the processing of steps S111 to S115, and the processing of steps S118 to S120 shown in FIG. 14, respectively.

When this printer is turned on, the control unit 5000 executes the following sequence of the application operation and the recording operation according to the flowchart shown in FIGS. 20A to 20C.

First of all, whether the paper feeding passage is the passage with application is determined (step S201). If it is determined that the paper feeding passage is the passage with application, determination as to whether the remaining amount of the application liquid is sufficient is made (step S202). If it is determined in step S202 that the remaining amount of the application liquid is sufficient, the application liquid is filled in the liquid retention space S to actuate the operation of the pump to perform a series of operations for liquid application (step S203 to S208). After the application step, the recording operation is performed onto the recording medium to which the application liquid has been applied over the part to which the application is required (step S209).

After that, whether the back side printing is needed in the recording medium on which the recording operation is currently being performed is determined (step S210). Two-sided printing information on whether the back side printing (two-sided printing) is needed is attached to the print job sent from the image supply apparatus. The two-sided printing information, as mentioned above, can be created in response to whether the user selects the two-sided printing using the GUI dialogue on the image supply apparatus.

In a case where it is determined in step S210 that the back side printing is not needed, the application roller 1001 and the pump 3007 are stopped, and the processing proceeds to step S204. In step 204, in a case where another recording-start command exists within a designated time of waiting, processing in steps S204 to S212 is repeated. In a case where no other recoding-start command exists, post-processing is performed (step S213) and this processing is completed.

In a case where it is determined in step S210 that the back side printing is needed, the recording medium on which the recording operation is currently being performed is temporarily held by the delivery roller 8 and the spur 9 without being delivered onto the delivery tray 10. Subsequently, the processing proceeds to step S222, and it is determined whether the passage for the back side printing is the passage with application. Two-sided printing information on whether the passage for the back side printing (two-sided printing) is the passage with application is attached to the print job sent from the image supply apparatus. Two-sided printing passage information can be created, as mentioned above, when the user selects the two-sided printing, and also selects a desired passage using the GUI dialogue.

If it is determined in step S222 that the passage for the back side printing is the passage with application, determination is made as to whether the remaining amount of the application liquid is sufficient (step S223). In a case where it is determined in step S223 that the remaining amount of the application liquid is sufficient, the application liquid is filled in the liquid retention space S, and the operation of the pump is actuated. Thus, a series of steps for the liquid application and the recording operation are performed (step S224 to S230).

At this time, in step S228, in a case where each of the transfer guides 58, 59, and 61 does not establish a required passage, the required passage related to each of the guides is established. Specifically, regarding the transfer guide 61, in a case where the third transfer passage is not established, the drive motor is driven to turn the transfer guide 61 about the pivot shaft 61*a*. Thus, the passage leading to the transfer passage 62*c* from the recording head 7 is established. The third transfer passage is established by this switching. Moreover, regarding the transfer guide 58, in a case where the transfer passage 62*c* and the transfer passage 62*a* are not connected to each other, the drive motor is driven to turn the transfer guide 58 about the pivot shaft 58*a*. Thus, the transfer passage 62*c* is connected to the transfer passage 62*a*. Furthermore, regarding the transfer guide 59, in a case where the passage leading to the transfer roller 4 from the application roller 1001 is not established, the drive motor is driven to turn the transfer guide 59 about the pivot shaft 59*a*. As a result, the passage leading to the transfer roller 4 from the application roller 1001 is established.

Subsequently, by rotating the transfer roller 4 and the delivery roller 8 in reverse, the recording medium being held as mentioned above is transferred to the interstice between the application roller 1001 and the counter roller 1002 through the third transfer passage. As a result, the recording medium is inserted into the interstice between these rollers (step S229).

Note that, in step S225, in a case where there is no back side recording start command within a designated time of waiting, post-processing is performed (step S234), and the whole processing is completed.

When the recording operation is performed in step S230, determination is made as to whether the recording operation should be finished in step S231. When it is determined that the recording operation is not to be finished, the processing proceeds to step S204. When it is determined that the recording operation is to be finished, the application roller 1001 and the pump 3007 are stopped (steps S232 and S233), post-processing is performed (step S234), and the whole processing is completed.

Incidentally, in a case where it is determined in step S201 that the paper feeding passage is the passage without application, the recording without application is performed (step S217 to S220). Subsequently, it is determined whether the back side printing is needed onto the recording medium onto which the recording operation is currently being performed (step S221). When it is determined in step S221 that the back side printing is not needed, the processing proceeds to step S217. Then, in a case where no new recording start command exists within the designated time of waiting, the whole processing is completed. In step S217, in a case where a new recording start command exists, processing in steps S217 to S221 is repeated.

In a case where it is determined in step S221 that the back side printing is needed, the recording medium onto which the recording operation is currently being performed is temporarily held between the delivery roller 8 and the spur 9 without being delivered onto the delivery tray 10. Subsequently, the processing proceeds to step S222, and whether the passage for the back side printing is the passage with application is determined. In a case it is determined that the passage for the back side printing is the passage with application, the processing proceeds to step S223. On the other hand, in a case where it is determined that the passage for the back side printing is the passage without application, the recording medium being held as mentioned above is delivered onto the delivery tray 10. At this time, the one-side printed recording medium on the delivery tray 10 is placed, by the user, in the paper feeding section 60 so that recording would be made on the back side (side where no printing has not been made) by the next recording operation.

In step S238 whether there is a start command for manual back side recording is determined. The user presses a recording start button included in the input operation section 5004 after placing the recording medium as described above. In response to the user's input, the control section 5000 creates the start command, and the start command causes recording without application to be performed on the back side (step S239 to S241).

Note that, in this embodiment, the start command for back side recording is created in response to the input from the user using the input operation section 5004. However, the present invention is not limited to this. For example, the start command may be inputted using the image supply apparatus. In this case, at the time when it is determined in step S222 that the paper feeding passage for back side is the passage without application, the GUI dialogue is displayed on the image supply apparatus to input whether the recording medium for back side printing has been placed in the paper feeding section 60. When the user inputs that the recording medium for back side printing has been placed in the paper feeding section 60 using the GUI dialogue, the image supply apparatus creates the start command and transmits the command to the inkjet recording apparatus. If the start command is transmitted to the ink jet recording apparatus after a designated time of waiting, the back side recording is carried out. On the other hand, if the start command is not transmitted, the inkjet recording apparatus may just let the whole processing be finished.

In addition, the recording without application may be performed in the following manners. First, a button is provided at the bottom of the paper feeding section 60. The button is pressed when the recording medium is placed on the bottom of the paper feeding section 60. Then, at the time of determination as to whether there is a start command for back side recording, the input by the button is considered as the recording command. Thus, the recording without application is performed. Similarly, a sensor is provided for the purpose of sending a detection signal when the recording medium is placed on the paper feeding section 60. Then, at the time of determination as to whether there is a start command for back side recording, if the detection signal that has been sent is considered as the recording command. Thus, the recording without application is performed.

In short, the inkjet recording apparatus just has to be informed that the recording medium has been placed, by the user, in the paper feeding section 60.

Once the recording operation is performed in step S241, determination is made in step S242 as to whether the recording operation should be finished. In a case where it is determined that the recording operation is not finished, the processing proceeds to step S217. In a case where it is determined that recording operation is finished, the whole processing is directly finished.

In a case where it is determined in step S202 that the remaining amount of the application liquid is insufficient, it is decided that the error display is to be performed (step S214). The error display is actually performed by the display unit 5000 (step S215). Subsequently, determination is made as to whether the user has decided to perform the recording without application (step S216). In a case where it is determined in step S216 that the user has decided to perform the recording without application, the processing proceeds to step S217, and the recording without application is performed. On other hand, in a case where it is determined that the user has not decided to perform the recording without application, the whole processing is directly finished.

Moreover, in a case where it is determined in step S223 that the remaining amount of the application liquid is insufficient, it is decided that the error display is to be performed (step S235). The error display is actually performed by the display unit 5005 (step S236). Then, determination is made as to whether the user should perform the recording for back side manually (step S237). In a case where the error display is performed in step S236, the control unit 5000 displays, on the GUI dialogue of the image supply apparatus, a message as to whether the recording for back side should be manually performed. Once the user decides, on the GUI dialogue, whether the recording for back side should be manually performed, the image supply apparatus transmits decision information on the aforementioned decision to the inkjet recording apparatus. In a case where the decision information is information indicating that the recording for back side is manually performed, the processing proceeds to step S238 and the recording without application is performed. If the decision information is information indicating that the recording for back side is not manually performed, the whole processing is directly finished while not performing the recording without application.

Note that, in this embodiment, there may be a case in which, using a recording medium to which the application liquid has been applied on one of the two sides, the passage without application is first selected, and the passage with application is selected later. Taking such a case into consideration, it is preferable that the same determination sequence as that of the first embodiment be performed irrespective of whether the recording media has a surface to which the liquid has been applied.

Third Embodiment

The first and second embodiments use the liquid retention member 2001 and the liquid channel 3000 as the liquid supply mechanism, but the present invention is not limited to this.

Figure 21:
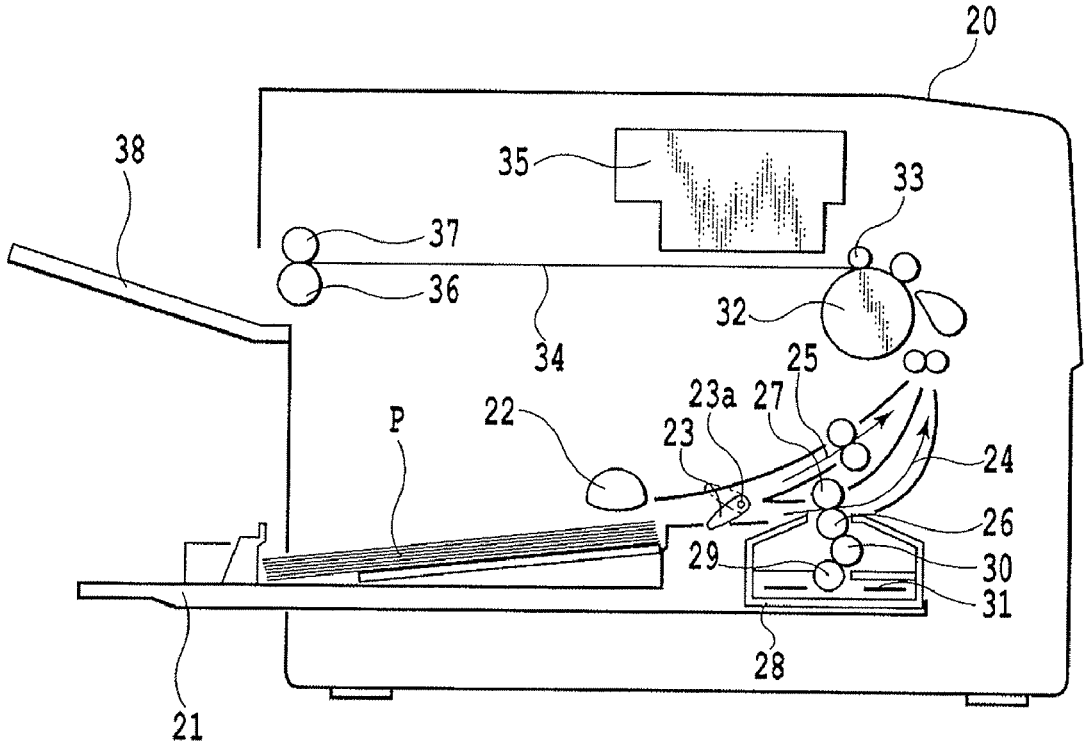
FIG. 21 is a longitudinal sectional side view showing a schematic configuration of an inkjet printer in an embodiment of the present invention.

FIG. 21 is a schematic view of an inkjet recording apparatus having a liquid supply mechanism different from that of the first and the second embodiments.

An inkjet recording apparatus 20 is provided with a feed cassette (paper feeding section) 21 on which a plurality of recording media P are stacked. A separation roller (paper feeding roller) 22, having a half-moon shaped cross section, separates a sheet of recording medium P from the recording media P stacked on the feed cassette 21. The separated sheet of recording medium P is fed to a transfer passage.

A transfer guide 23 is provided at the subsequent stage of the paper feeding roller 22. The transfer guide 23 can turn about a pivot shaft 23*a*. A transfer passage 24 as a passage with application and a transfer passage 25 as a passage without application are provided at the subsequent stage of the transfer guide 23. A turn of the transfer guide 23 about the pivot shaft 23*a* in a required manner allows the paper feeding section 21 to be connected to the transfer passage 24, or to the transfer passage 25. The turn of this transfer guide (the switching from the passage with application to passage without application, or vice versa) is performed by a control signal from a control unit (not shown). Needless to say, the inkjet apparatus 20 related to this embodiment includes the control unit having a function similar to that of the control unit 5000 included in the inkjet recording apparatus 1 explained in the first and the second embodiments.

An application roller 26 and a counter roller 27 placed opposite the application roller 26 are arranged as a liquid application mechanism in the transfer passage 24. In addition, a storage tank 28 that stores an application liquid 31, an application supply roller 29, and a film thickness control roller 30 are arranged as a liquid supply mechanism in the transfer passage 24.

In FIG. 21, the film thickness control roller 30 follows (rotates by following) the application roller 26 or can be driven and controlled by drive means (not shown). Furthermore, the application liquid supply roller 29 follows the film thickness control roller 30 or can be driven and controlled by drive means (not shown). The above-mentioned rotations of the application liquid supply roller 29 and the film thickness control roller 30 causes the application liquid to be applied to the application roller 26.

In a case where the paper feeding passage is the passage with application, the transfer guide 23 is switched as required. The paper feeding section 21 is connected to the transfer passage 24 and the recording medium P is guided to the transfer passage 24. At this time, the application roller 26 rotates clockwise in the figure and applies the application liquid over the part of the recording medium P, which part requires the application.

On the other hand, in a case where the paper feeding passage is the passage without application, the transfer guide 23 is switched as required. The paper feeding section 21 is connected to the transfer passage 25 and the recording medium P is guided to the transfer passage 25. At this time, the application liquid is not applied to the recording medium P.

The recording medium P transferred along the transfer passage 24 or the transfer passage 25 is sent to the interstice between a transfer roller 32 and a pinch roller 33. By the transfer roller 32, driven and rotating counterclockwise (in FIG. 21), the recording medium P is transferred on a platen 34.

Recording is performed on the recording medium P transferred on the platen 34 at the position facing a recording head 35. This recording can be performed in the same way as the recording head 7 explained in the first and the second embodiments. With the recording operation, the recording medium P is delivered onto a delivery tray 38 by a delivery roller 36 and a spur 37 provided at the downstream side of the scanning region of the recording head 35 in the transfer passage of the recording media P.

In this embodiment, the liquid application mechanism and the liquid supply mechanism are not limited to those described above. Any configuration can be used as long as the configuration causes the application member to be brought into contact with the recording medium to apply the liquid to the recording medium.

Other Embodiments

In the aforementioned embodiment, the application member, which transfers and applies the application liquid retained by the liquid retention member to the recording medium, is not limited to the application roller. For example, a belt-like application member, such as an endless belt, may be used, instead.

Although, in the above embodiment, the description has been given of an example in which the liquid is applied using the inkjet-type recording apparatus, the present invention is applicable to a recording apparatus of another type. The effects can be obtained also by a recording apparatus of other type, such as the thermal-transfer type and the electrophotographic type. In the recording apparatus of the above-mentioned types, the use of a liquid containing a fluorescent brightening agent as the application liquid improves the brightness of the media. In addition, as the application liquid in a recording apparatus of the silver-halide photographic type, a sensitizer may be applied before recording.

Still Other Embodiments

Additionally, the present invention can be achieved by the way described below. A computer (or CPU or MPU) of the inkjet recording apparatus is caused to read out and to execute a program code stored in a storage medium. The program code causes the operations explained in the aforementioned embodiments.

In this case, the very program code read out from the storage medium implements the functions of each of the aforementioned embodiments. For this reason, the storage medium, which has the program code recorded therein, configures the present invention.

Examples of the storage medium for supplying the program code are, a floppy disk (registered trademark), a hard disk, an optical disk, a magneto-optical disk, CD-ROM, CD-R, a magnetic tape, a nonvolatile memory card, ROM, and so on.

The functions of the aforementioned embodiments are implemented by the computer executing the read out program code. In addition to this, a case is also included in which OS (Operating System) running on the computer executes some parts, or all, of the actual processing based on instructions of the program code, and thus the processing implements the functions of the aforementioned embodiments.

Moreover, the following embodiment is also included. The program code read out from the storage medium is written in a memory provided in a function extension board inserted into the computer or a function extension unit connected to the computer. After that, the CPU and the like provided in the extension board or extension unit execute some parts, or all, of the actual processing based on instructions of the program code, and the processing implements the functions of the aforementioned embodiments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-353973, filed Dec. 7, 2005, which is hereby incorporated by reference herein in its entirety.

What is claimed is:

1. An inkjet recording apparatus capable of recording an image on a recording medium by ejecting ink from a recording head to the recording medium to which liquid that reacts with the ink has been applied by application means, comprising:

a first transfer passage having the application means disposed therein, for transferring the recording medium, to which the liquid has been applied by the application means, to a position facing the recording head;

storage means for storing the liquid to be supplied to the application means;

determination means for determining whether an amount of liquid stored in the storage means is less than a designated amount;

prohibition means for prohibiting use of the first transfer passage even if ejecting ink from the recording head is practicable, in a case where the determination means determines that the amount of liquid is less than the designated amount; and a second transfer passage different from the first transfer passage, wherein the second transfer passage is used for transferring the recording medium, to which the liquid is not applied, to the position facing the recording head, wherein control relating to the recording is made different between a case where the recording medium is transferred using the first transfer passage and a case where the recording medium is transferred using the second transfer passage, and wherein an amount of ink ejected from the recording head in the case where the recording medium is transferred using the first transfer passage is greater than an amount of ink ejected from the recording head in the case where the recording medium is transferred using the second transfer passage.

2. An inkjet recording apparatus capable of recording an image on a recording medium by ejecting ink from a recording head to the recording medium to which liquid that reacts with the ink has been applied by application means, comprising:

a first transfer passage having the application means disposed therein, for transferring the recording medium, to which the liquid has been applied by the application means, to a position facing the recording head;

storage means for storing the liquid to be supplied to the application means;

determination means for determining whether an amount of liquid stored in the storage means is less than a designated amount;

prohibition means for prohibiting use of the first transfer passage even if ejecting ink from the recording head is practicable, in a case where the determination means determines that the amount of liquid is less than the designated amount; and a second transfer passage different from the first transfer passage, wherein the second transfer passage is used for transferring the recording medium, to which the liquid is not applied, to the position facing the recording head, wherein control relating to the recording is made different between a case where the recording medium is transferred using the first transfer passage and a case where the recording medium is transferred using the second transfer passage, and wherein a transfer speed in the case where the recording medium is transferred using the first transfer passage is higher than a transfer speed in the case where the recording medium is transferred using the second transfer passage.

* * * * *